United States Patent [19]

Imamaki et al.

[11] Patent Number: 4,913,567

[45] Date of Patent: Apr. 3, 1990

[54] HEAD-PRESSURE MECHANISM IN THERMAL PRINTER

[75] Inventors: Teruo Imamaki; Yoshiaki Yuki, both of Nagoya; Michio Ueda, Gamagori; Shigenori Hattori, Aichi, all of Japan

[73] Assignee: Brother Kogyo Kabushiki Kaisha, Japan

[21] Appl. No.: 139,835

[22] Filed: Dec. 30, 1987

[30] Foreign Application Priority Data

| | | | |
|---|---|---|---|
| Jan. 7, 1987 | [JP] | Japan | 62-1169 |
| Jan. 7, 1987 | [JP] | Japan | 62-1170 |
| May 20, 1987 | [JP] | Japan | 62-75557[U] |

[51] Int. Cl.[4] ..... B41J 3/20

[52] U.S. Cl. ..... 400/120; 346/76 PH; 74/461

[58] Field of Search ..... 400/120, 356; 346/76 PH; 74/461; 192/20, 26, 28, 56 R

[56] References Cited

U.S. PATENT DOCUMENTS

| | | | |
|---|---|---|---|
| 674,447 | 5/1901 | Mase | 74/461 |
| 4,396,308 | 8/1981 | Applegate et al. | 400/120 |
| 4,641,150 | 2/1987 | Matsuura et al. | 400/120 |
| 4,654,673 | 3/1987 | Yanata et al. | 400/120 |

FOREIGN PATENT DOCUMENTS

| | | | |
|---|---|---|---|
| 60-17712 | 5/1985 | Japan | 400/120 |
| 155485 | 8/1985 | Japan | 400/120 |
| 188164 | 8/1986 | Japan | 400/120 |
| 225086 | 10/1986 | Japan | 400/120 |
| 280970 | 12/1986 | Japan | 400/120 |

OTHER PUBLICATIONS

"Motor Drive Arrangement . . . "; Applegate et al.; *IBM Tech. Disc. Bull.;* vol. 25, No. 11B, pp. 6236–6238; Apr. 1983.

"Path Equalizing for Guide Bar"; Craft; *IBM Tech. Disc. Bull.;* vol. 27, No. 1B, p. 891; Jun. 1984.

*Primary Examiner*—David A. Wiecking

*Attorney, Agent, or Firm*—Oliff & Berridge

[57] ABSTRACT

A printer wherein printing is effected while a print head and a recording medium are moved relative to each other with the print head in pressed contact with the medium. The printer includes a print-head support member for supporting the print head movably between a printing position and a release position. The printer further includes a support member and a displaceable member which are connected by an elastic member, so that the print head is moved from the release position to the printing position, and the print head in the printing position is pressed against the medium. The displacement of the displaceable member consists of a first movement for moving the print head to the printing position, and a second movement for enabling the elastic member to produce a biasing force for pressing the print head against the medium. An amount of displacement of the displaceable member per unit angle of rotation of the rotatable member is greater in the first movement than in the second movement.

22 Claims, 9 Drawing Sheets

HEAD-PRESSURE MECHANISM IN THERMAL PRINTER

BACKGROUND OF THE INVENTION

1. Field of the Invention

The present invention relates in general to a printing apparatus wherein a printing operation is effected by a print head which is movable relative to recording medium while the print head and the medium are held in pressed contact with each other. More particularly, the invention is concerned with an improved mechanism for moving the print head of such a printing apparatus to its printing and release positions. The present invention further relates to an improved mechanism for pressing a thermal ink ribbon against the recording medium.

2. Discussion of the Prior Art

A thermal printer is a typical example of the printing apparatus indicated above. One type of the thermal printer uses a thermal ink ribbon having a thermally fusible ink layer which is pressed by the print head against the surface of the recording medium, so that local portions of the ink layer heated by the print head are transferred to the recording medium. There is known another type of thermal printer which employs a heat-sensitive recording medium whose local portions heated by the print head are blackened or otherwise colored. In any types of thermal printer as described above, the print head is movable to its printing position in which the print head is in pressed contact with the recording medium, and its release position in which the print head is spaced away from the medium. Therefore, the thermal printer should include a print-head support member for movably supporting the print head, and an actuator mechanism for moving the print head to its printing and release positions.

In the known thermal printer, it is common that the print-head support member is biased by a spring so that the print head is biased toward its recording medium. Namely, the print head is normally placed in its printing position. In this arrangement, a cam or other actuator mechanism used to move the print head away from the recording medium to its release position should overcome the biasing force of the spring, which increases as the print head is moved toward the release position. The biasing spring is pre-loaded so as to provide a desired pressing force which acts on the print head held in its printing position. Since the movement of the print head toward its release position results in an increase in the amount of elastic deformation of the biasing spring, the load which is applied to the actuator mechanism must be greater than the biasing force acting on the print head in the printing position, and therefore requires a comparatively large drive source.

In the light of the above drawback, an improved thermal printer is proposed in Japanese patent application published on May 4, 1985 under Publication No. 60-17712 (for opposition purpose). In this printer, the print head is normally placed in its release position by a first biasing member, and a solenoid-operated print-head actuator is connected to the print head via a second biasing member. When a printing operation is initiated, the drive force of the solenoid is imparted via the second biasing member to the print head, to move the print head from the release position to the printing position, while overcoming the biasing force of the first biasing member. After the print head is moved to the printing position, the second biasing member is elastically deformed by the solenoid, whereby the print head is pressed against the recording medium. In the present arrangement, since the biasing force to hold the print head in the release position may be very small, the required drive force produced by the solenoid is substantially equal to the desired pressing force which acts on the print head, and therefore the required capacity of the solenoid is relatively small.

Since the solenoid is used as a drive source to move the print head to its printing position, the print head abuts on the platen of the printer at a comparatively high speed, causing considerably high magnitudes of impact of the print head against the platen and consequent operating noises. Therefore, the print-head actuator using such a solenoid is not desirable from the standpoint of durability of the print head and the actuator mechanism, and damages to the recording medium. In this connection, it is noted that the solenoid is difficult to control its operating speed. Namely, it is difficult to control the moving speed of the print head to its printing position. Even if the print head moving speed could be made lower by some means or other to solve the above inconveniences, the instant arrangement still suffers from a relatively long total operating time required to move the print head to the printing position and press the print head against the recording medium (platen).

Similar problems are encountered with respect to a ribbon-presser mechanism for pressing a ribbon-presser member used to press the ink ribbon against the recording medium, where the thermal printer has a function of erasing printed characters by means of the ink ribbon. This type of thermal printer is disclosed in Japanese patent application laid open on Feb. 24, 1983 under Publication No. 58-31787 which corresponds to U.S. Pat. No. 4,396,308.

Described more specifically, the thermal printer having such an erasing function has a ribbon-presser member in the form of a roller, for example, which is located at a position spaced away from the print head by a suitable distance along the line of printing. The ribbon-presser member is supported movably between its non-operated and operated positions. In the operated position, the ribbon-presser member is held in pressed contact with the ink ribbon. The ink ribbon has an ink layer consisting of an inking material which produces a sufficient adhesive force at temperatures between the room temperature and the printing temperature of the ribbon. A printing operation is effected while the ink ribbon pressed by only the print head against the recording medium, as described above. When printed characters are erased, the ink ribbon is pressed against the recording medium, by both the print head and the ribbon-presser member. The print head is operate according to the same printing data as used for the already printed characters, whereby the printed characters are overstruck by the print head via the ink ribbon. The used portion of the ink ribbon is separated from the recording medium after the used portion is kept in pressed contact with the medium for a time corresponding to the distance between the print head and the ribbon-presser member. As a result, the locally heated portion of the ink ribbon are cooled down from the printing temperature to a temperature at which the inking material demonstrates a considerably high adhesive strength, which causes the previously transferred inking material (forming the printed characters) to adhere back to the ink ribbon. Thus, the inking material of the printed characters may be removed from the recording medium by the ink ribbon.

Thus, the thermal printer having the ribbon-presser member requires a ribbon-presser mechanism for moving the ribbon-presser member between its non-operated and operated positions, and therefore suffers from the same problems as experienced by the print-head presser mechanism.

SUMMARY OF THE INVENTION

It is accordingly an object of the present invention to provide an improved printing apparatus of the type indicated above, wherein the print head can be moved to the printing position and pressed against the recording medium in a reduced total operating time, by a comparatively small operating force, and with minimum magnitudes of operating impact and noises.

The above object may be attained according to the principle of the present invention, which provides a printing apparatus wherein a printing operation is effected by a print head which is movable relative to a recording medium while the print head and the medium are held in pressed contact with each other, the printing apparatus comprising: (a) a print-head support member for supporting the print head movably between a printing position in which the print head is in pressed contact with the medium, and a release position in which the print head is spaced away from the medium; (b) drive means for moving the support member; (c) a converting mechanism including a rotatable member which is rotated by the drive means, and a displaceable member which is displaced as the rotatable member is rotated, whereby a rotating movement of the rotatable member is converted into a displacement of the displaceable member; and (d) an elastic member connecting the support member and the displaceable member, to thereby move the print head from the release position to the printing position, and press the print head in the printing position against the medium with a predetermined force. The displacement of the displaceable member consists of a first movement for moving the print head to the printing position, and a second movement for enabling the elastic member to produce a biasing force for pressing the print head against the medium with the predetermined force. The converting mechanism is constructed so that an amount of displacement of the displaceable member per unit angle of rotation of the rotatable member is greater in the first movement than in the second movement.

In the printing apparatus of the present invention constructed as described above, the print head is moved from the release position to the printing position, by the rotating movement of the rotatable member, which is imparted to the print head through the displaceable member, the elastic member and the print-head support member. After the print head has reached its printing position, the rotatable member is rotated a further angle so as to cause the elastic member to be elastically deformed and thereby bias the print head against the surface of the recording medium, so that the print head is ready for printing on the medium.

The amount of displacement of the displaceable member produced per unit angle of rotation of the rotatable member is made comparatively large, during its first movement for moving the print head from the release position to the printing position. In other words, the print head can be moved to the printing position at a comparatively high speed, with a comparatively small angle of rotation of the rotatable member. On the other hand, the amount of displacement of the displaceable member per unit angle of rotation of the rotatable member is made comparatively small, during its second movement for pressing the print head in the printing position against the recording medium, so that the print head is slowly pressed against the medium, with a gradual increase in the amount of elastic deformation of the elastic member by the displacement of the displaceable member at a relatively low rate.

In the instant printer, the required operating force to rotate the rotatable member does not exceed the desired pressing force which acts on the print head, that is, is equal to the desired pressing force. Where the converting mechanism is adapted to be able to hold the print head at the release position, for example, where the rotatable member is a grooved cam, it is not necessary to use a release spring to hold the print release position head at the print. Even where a release spring is used, its biasing force to hold the print head at the release position may be very small. Further, the print head can be quickly located at a position just before its printing position, by a comparatively rapid displacement of the displaceable member. On the other hand, since the displacement of the displaceable member for pressing the print head occurs at a comparatively low rate, the impact of the print head against the platen and the resulting noises can be substantially eliminated. Thus, the present printing apparatus requires a relatively small drive force for pressing the print head, and a relatively short total time for moving and pressing the print head, while assuring high durability of the converting mechanism for moving and pressing the print head, and avoiding the operating noises and damages to the recording medium, as experienced in the known apparatus. Further, the print head can be rapidly moved back to the release position, whereby the printed characters which are covered by the print head in the printing position can be observed immediately after the movement to the release position is initiated.

According to one feature of the present invention, the rotatable member comprises a cam having a cam surface, while the displaceable member comprises a cam follower which engages the cam surface. The elastic member is connected to the cam follower and the print-head support member, and the cam surface includes a first area for producing the first movement of the displaceable member, and a second area for producing the second movement of the displaceable member. The first area has a greater gradient than the second area.

According to another feature of the invention, the printing apparatus further comprises biasing means for biasing the print-head support member toward the release position. In this case, the elastic member is preferably given a pre-load greater than a biasing force of the biasing means, so that the elastic member is prevented from initiating elastic deformation until the print head contacts the recording medium. The elastic member may consist of a coil spring whose turns are held in contact with each other by a tensile pre-load greater than the biasing force of the biasing means.

According to a further feature of the invention, the printing apparatus further comprises: (e) an ink ribbon which is disposed so as to extend between the print head and the recording medium, and which comprises an ink layer consisting of an inking material which is thermally fusible for adhesion to a surface of the medium; (f) a ribbon-presser member disposed away from the print head in a direction parallel to a line of printing by the print head, for pressing the ink ribbon against the recording medium; (g) a ribbon-presser support member for supporting the ribbon-presser member movably between an operated position in which the ribbon-presser member is in pressed contact with the medium via the ink ribbon, and a non-operated position in which the ribbon-presser member is spaced away from the medium; (h) a second converting mechanism in addition to the above-indicated converting means as a first converting means, the second converting mechanism including a second rotatable member which is rotated by the drive means, and a second displaceable member which is displaced as the second rotatable member is rotated, whereby a rotating movement of the second rotatable member is converted into a displacement of the second displaceable member; and (i) a second elastic member in addition to the above-indicated elastic member as a first elastic member, the second elastic member connecting the ribbon-presser support member and the second displaceable member, to thereby move the ribbon-presser member from the non-operated position to the operated position, and press the ribbon-presser member in the operated position against the medium with a predetermined second force. The displacement of the second displaceable member consists of one movement for moving the ribbon-presser member to the operated position, and another movement for causing the second elastic member to produce a second biasing force for pressing the ribbon-presser member against the medium with the predetermined second force. The second converting mechanism is constructed such that an amount of displacement of the second displaceable member per unit angle of rotation of the second rotatable member is greater in the one movement than in the another movement.

In one form of the above feature of the invention, the rotatable member comprises a first cam having a first cam surface, while the displaceable member comprises a first cam follower which engages the first cam surface. The first elastic member is connected to the first cam follower and the print-head support member, and the first cam surface includes a pair of symmetrically formed first areas each for producing the first movement of the first displaceable member, and a pair of symmetrically formed second areas each for producing the second movement of the first displaceable member. The first area having a greater gradient than the second area. The first cam surface further includes a third area for holding the print head in the release position during a corresponding movement of the first cam. The pair of second areas terminate in the pair of first areas, which in turn terminate in corresponding opposite ends of the third area. The second rotatable member comprises a second cam having a second cam surface, while the second displaceable member comprises a second cam follower which engages the second cam surface. The second elastic member is connected to the second cam follower and the ribbon-presser support member, and the second cam surface includes a first area for producing the above-indicated one movement of the second displaceable member, and a second area for producing the second movement of the second displaceable member. The first area of the second cam surface has a greater gradient than the second area of the second cam surface. The second cam surface further includes a third area for holding the ribbon-presser member in the non-operated position during a corresponding movement of the second cam, and the second area of the second cam surface terminates in the first area of the second cam surface, which in turn terminates in the third area of the second cam surface.

In another form of the same feature of the invention, the print head, the print-head support member, the first converting mechanism, the first elastic member, the ribbon-presser member, the ribbon-presser support member, the second converting means and the second elastic member are mounted on a base as a sub-assembly. The sub-assembly is incorporated in a carriage of the printing apparatus such that the base is mounted on the carriage by suitable mounting means.

In a further form of the same feature of the invention, the drive means consists of a single electrically operated motor for operating the rotatable member and the second rotatable member.

In accordance with a still further feature of the above aspect of the invention, the printing appratus further comprises a reference-position detecting device for detecting a reference point of the rotatable member. The drive means is operable to rotate the rotatable member selectively in opposite directions, within a predetermined angular range whose phase is determined by the detected reference point of the rotatable member. In this arrangement, the rotatable member can be rotated in a selected one of the opposite directions within the predetermined angular range which is determined with respect to the reference point detected by the reference-position detecting device.

In one form of the above feature of the invention, the reference-position detecting device comprises: (a) a drive gear driven by the drive means; (b) a driven gear engaging the drive gear and connected to the rotatable member, the driven gear including a non-toothed circumferential portion which has a special tooth at one of opposite circumferential ends thereof, the reference point of the rotatable member being established at a reference angular position of the driven gear in which the special tooth of the driven gear engages one of teeth of the drive gear; (c) means for holding the driven gear at the reference angular position; and (d) means for elastically supporting the special tooth on the driven gear, and thereby allowing the special tooth to be retracted in a direction that permits the special tooth to be disengaged from the teeth of the drive gear while the driven gear is held in the reference angular position. In this arrangement, the successive teeth of the drive gear rotated by the drive means can be engaged with and disengaged from the special tooth of the driven gear while the driven gear is held at the reference angular position. Namely, when each tooth of the rotating drive gear engages the special tooth at the end of the non-toothed portion of the driven gear, the elastically supported special tooth is retracted in the radially inward direction of the drive gear, thereby permitting the rotation of the drive gear while holding the driven gear stopped at the reference angular position. Thus, the rotatable member connected to the driven gear can be brought to its reference point, by rotating the drive gear by the drive means. Thus, the drive means and the rotatable member can be initialized before the rotatable member is rotated to move the print head from its release position to the printing position. Since the special tooth of the driven gear in the reference angular position is held in engagement with a given tooth of the drive gear, the rotation of the driven gear (rotatable member) can be smoothly commenced as soon as the rotation of the drive gear by the drive means has been started.

According to a preferred arrangment of the above form of the invention, the above-indicated means for elastically supporting the special tooth consists of an elongate spring portion which has a fixed end connected to a body of the driven gear and which extends from the fixed end toward a free end thereof substantially in the circumferential direction of the driven gear. In this instance, the special tooth is supported at the free end of the spring portion. The elongate spring portion may be provided by forming a cutout in the body of the driven gear. The cutout includes a cut formed through a bottom land between the special tooth and a next tooth of the driven gear adjacent to the special tooth, and further includes a recess which extends from the cut, along the non-toothed circumferential portion, so as to define the elongate spring portion.

Another object of the invention is to provide an improved printing apparatus wherein printed characters can be erased from the recording medium by an ink ribbon while a suitable length of the ribbon is held against the medium, and wherein the ink ribbon can be pressed against the medium in a reduced total operating time, by a comparatively small operating force, and with minimum magnitudes of operating impact and noises The above object may be achieved according to another aspect of the present invention, which provides a printing apparatus wherein a printing operation is effected by a print head which is movable relative to a recording medium while the print head and the medium are held in pressed contact with each other, the printing apparatus comprising: (a) an ink ribbon which is disposed so as to extend between the print head and the recording medium, and which comprises an ink layer consisting of an inking material which is thermally fusible for adhesion to a surface of the medium; (b) a ribbon-presser member disposed away from the print head in a direction parallel to a line of printing by the print head, for pressing the ink ribbon against the recording medium; (c) a ribbon-presser support member for supporting the ribbon-presser member movably between an operated position in which the ribbon-presser member is in pressed contact with the medium via the ink ribbon, and a non-operated position in which the ribbon-presser member is spaced away from the medium; (d) a converting mechanism including a rotatable member which is rotated by the drive means, and a displaceable member which is displaced as the rotatable member is rotated, whereby a rotating movement of the rotatable member is converted into a displacement of the displaceable member; and (e) an elastic member connecting the ribbon-presser support member and the displaceable member, to thereby move the ribbon-presser member from the non-operated position to the operated position, and press the ribbon-presser member in the operated position against the medium with a predetermined force. The displacement of the displaceable member consists of a first movement for moving the ribbon-presser member to the operated position, and a second movement for causing the elastic member to produce a biasing force for pressing the ribbon-presser member against the medium with the predetermined force. The converting mechanism is constructed such that an amount of displacement of the displaceable member per unit angle of rotation of the rotatable member is greater in the first movement than in the second movement. The present printer provides advantages similar to those of the apparatus described above wherein the print head is pressed against the recording medium.

According to a further aspect of the present invention, there is provided a printing apparatus which includes a print head mounted on a carriage for effecting a printing operation on recording medium via an ink ribbon, the apparatus comprising: (a) a first pivotable member supported on the carriage pivotally between a release position in which the print head is spaced away from the recording medium, and a printing position in which the print head is held in pressed contact with the medium via the ink ribbon; (b) a first elastic member; (c) a first cam follower connected to the first pivotable member through the first elastic member; (d) a first cam engaging the first cam follower, and having a first cam surface which includes a first area for moving the print head from the release position to the printing position, and a second area for pressing the print head in the printing position against the medium; (e) a ribbon-presser member disposed away from the print head in a direction parallel to a line of printing by the print head, for pressing the ink ribbon against the medium; (f) a second pivotable member supported on the carriage pivotally between an operated position in which the ribbon-presser member is held in pressed contact with the medium via the ink ribbon, and a non-operated position in which the ribbon-presser member is spaced away from the medium; (g) a second elastic member; (h) a second cam follower connected to the second pivotable member through the second elastic member; (i) a second cam engaging the second cam follower, and having a second cam surface which includes a first area for moving the ribbon-presser member from the non-operated position to the operated position, and a second area for pressing the ribbon-presser member in the operated position against the medium, the first and second cams being supported rotatably in synchronization with each other such that the first area of the first cam surface is offset from the first area of the second cam surface in a rotation direction of the first and second cams; and (j) single drive means for rotating the first and second cams.

In accordance with one feature of the above aspect of the invention, the first areas of the first and second cam surfaces are offset from each other such that upon synchronous rotation of the first and second cams, the print head comes into contact with the medium via the ink ribbon after the ribbon-presser member presses the ink ribbon against the medium.

According to a still further aspect of the invention, there is provided a reference-position detecting device for detecting, as a reference point, a predetermined angular position of a driven gear driven by a drive gear, comprising: (a) a non-toothed circumferential portion formed on the driven gear, and having a special tooth at one of opposite circumferential ends thereof, the predetermined angular position as the reference point being established when the special tooth of the driven gear engages one of teeth of the drive gear; (b) means for holding the driven gear at the predetermined angular position; and (c) means for elastically supporting the special tooth on the driven gear, and thereby allowing the special tooth to be retracted in a direction that permits the special tooth to be disengaged from the teeth of the drive gear while the driven gear is held in the predetermined angular position.

BRIEF DESCRIPTION OF THE DRAWINGS

The above and other objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
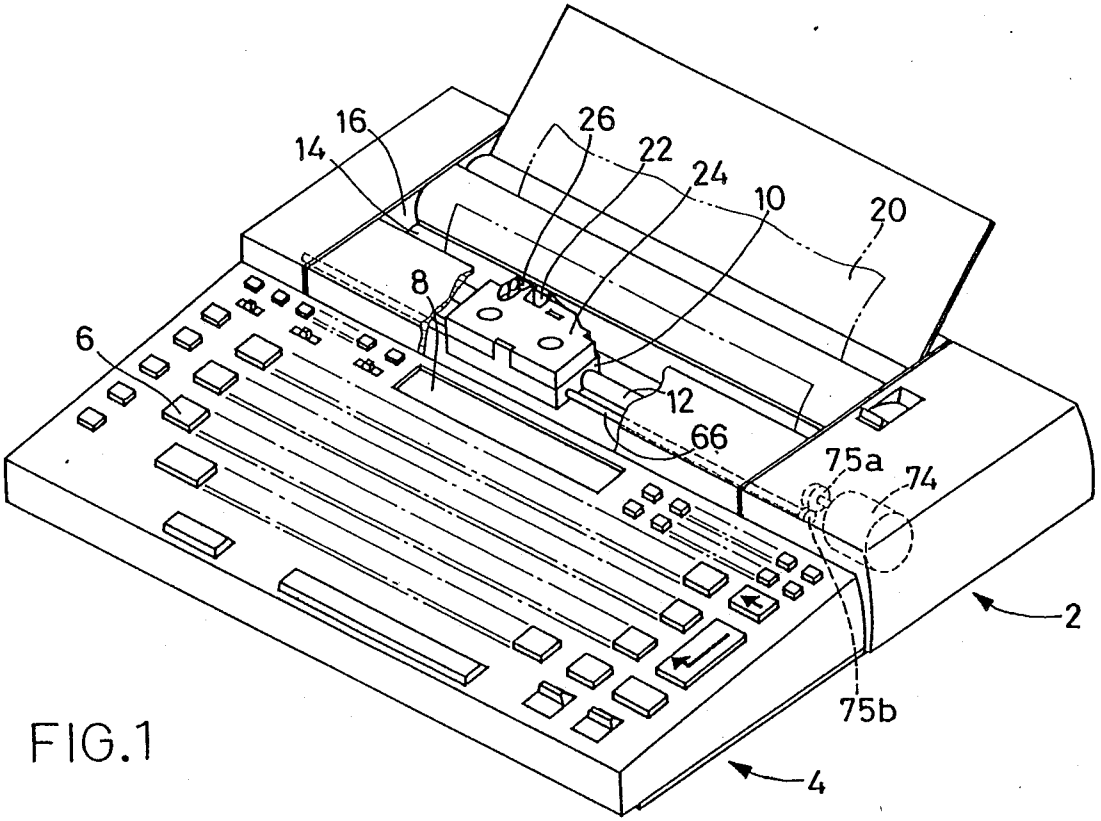
FIG. 1 is a perspective view of an electronic typewriter which incorporates one embodiment of a printing apparatus of the present invention in the form of a thermal printer.

Referring first to FIG. 1, the electronic typewriter includes a printing apparatus in the form of a thermal printer indicated generally at 2. The thermal printer 2 is connected to a keyboard 4 such that the printer 2 and the keyboard 4 constitute an integral unit. The keyboard 4 has a multiplicity of keys such as alphabet keys 6, and incorporates a liquid crystal display 8 having a suitable digit capacity. Characters such as letters, numerals and symbols entered through the keyboard 4 are displayed on the display 8, and are printed by the thermal printer 2 according to various function commands also entered through the keyboard 2.

The thermal printer 2 includes a carriage 10 slidably supported by a guide bar 12 which extends along a length of a platen 14, namely, in an X-axis direction. The thus supported carriage 10 is reciprocated in the X-axis direction by a suitable drive motor (not shown) attached to a printer frame 16. The platen 14 is adapted to support a recording medium in the form of a sheet of paper 20. The sheet 20 is fed in a Y-axis direction perpendicular to the X-axis direction, by suitable feed rollers (not shown) which are disposed behind the platen 14 and which are driven by a suitable drive motor.

Figure 10:
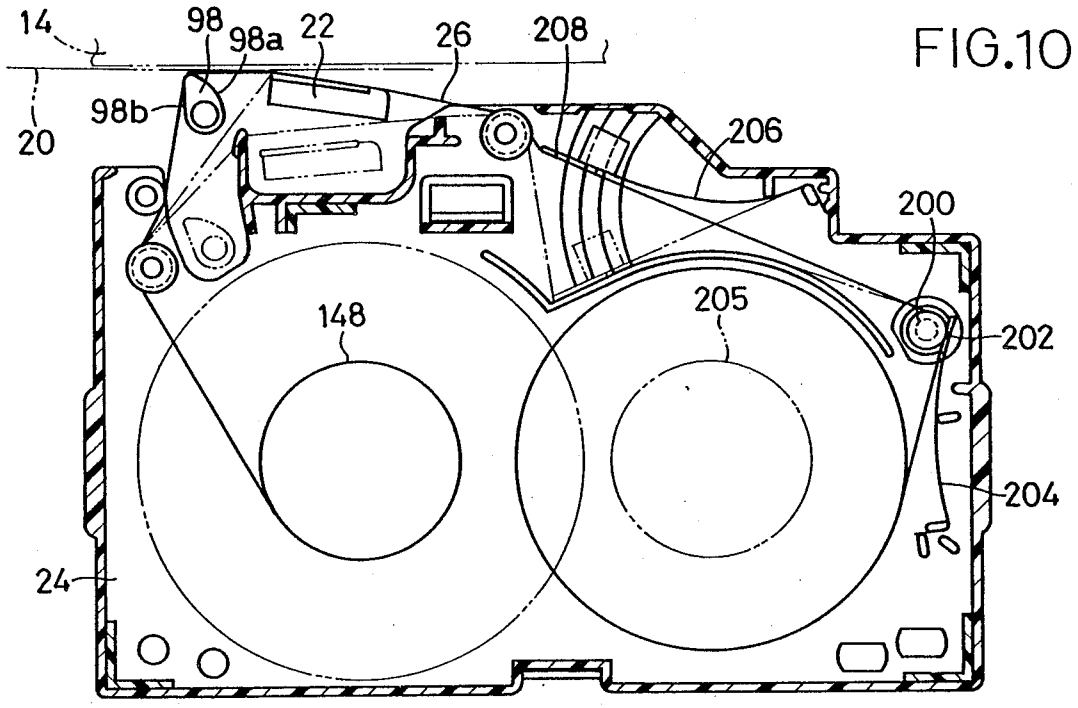
FIG. 10 is a cross sectional view of a ribbon casstte and the thermal print head, illustrating a ribbon feed path relative to the print head.

The carriage 10 has a thermal print head 22 mounted thereon. The paper sheet 20 is fed so that the sheet 20 is held between the print head 22 and the platen 14. The carriage 10 also carries a ribbon cassette 24 removably mounted thereon. The cassette 24 accommodates and feeds an ink ribbon 26 along a feed path as indicated in FIG. 10, so that an active length of the ribbon 26 outside the cassette 24 passes between the thermal print head 22 and the sheet 20. When a printing operation is effected by the print head 22 on the sheet 20, the print head 22 is pressed against the sheet 20 via the ink ribbon 26, so that a thermally fusible inking material of an ink layer of the ribbon 26 is fused by heat generated by the thermal print head 22, for adhesion to the surface of the paper sheet 20. Thus, a desired image can be transferred to the sheet 20.

Figure 2:
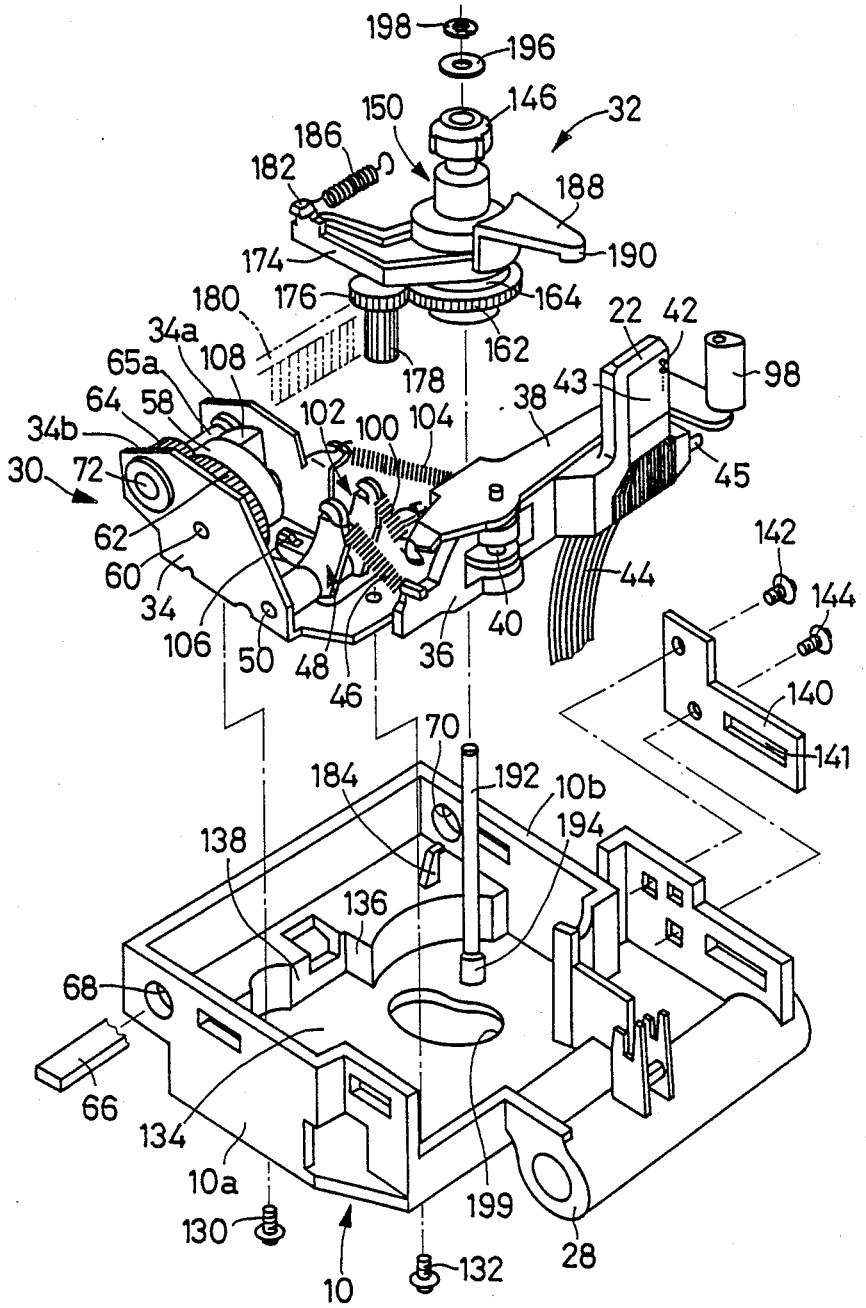
FIG. 2 is an exploded perspective view showing a carriage of the thermal printer of FIG. 1, and a mechanism mounted on the carriage.

Referring further to the exploded perspective view of FIG. 2, there is shown a mechanism incorporated on the carriage 10. The carriage 10 has a sliding portion 28 defining a bore through which the guide bar 12 is inserted. The mechanism incorporated in the carriage 10 includes an actuator unit 30 for the print head 22 and a ribbon-presser member 98 (which will be described), and further includes a ribbon take-up unit 32 for feeding the ink ribbon 26. This actuator unit 30 and ribbon take-up unit 32 are assembled as sub-assemblies, and mounted on the carriage 10, as described below.

The actuator unit 30 is provided with a unit frame 34 in which a print-head support lever 36 and a ribbon-presser support lever 38 are supported pivotally about a common axis in the form of a shaft 40, in the horizontal plane. The print-head support lever 36, which serves as a support member for the print head 22, is formed integrally with the thermal print head 22, such that the print head 22 is positioned at one end of the lever 36. The thermal print head 22 has a printed-circuit board 43 which incorporates a plurality of heat-generating elements 42 arranged in at least one straight row. This board 43 provides a printing face of the thermal print head 22. The heat-generating elements 42 are energized through printed conductors formed on the surface of the board 43, and a cable 44 which is connected at one end to the printed conductors, and at the other end to a control system of the typewriter. Upon selective energization of the heat-generating elements 42, the corresponding portions of the thermally fusible ink layer of the ink ribbon 26 are heated for transfer to the sheet of paper 20. The print-head support lever 36 has a guide pin 45 (which will be described later) extending from its end face adjacent to the print head 22.

The print-head support lever 36 is pivoted at its intermediate portion through which the pivot shaft 40 extends. The other end of the support lever 36 opposite to the end at which the print head 22 is supported is connected by an elastic member in the form of a head-presser spring 46, to a cam follower in the form of a cam lever 48. The cam lever 48 is pivotally supported by a lever shaft 50 supported by the unit frame 34. The shaft 50 extends in the horizontal plane so that the cam lever 48 is pivotable in the vertical plane.

Figure 3:
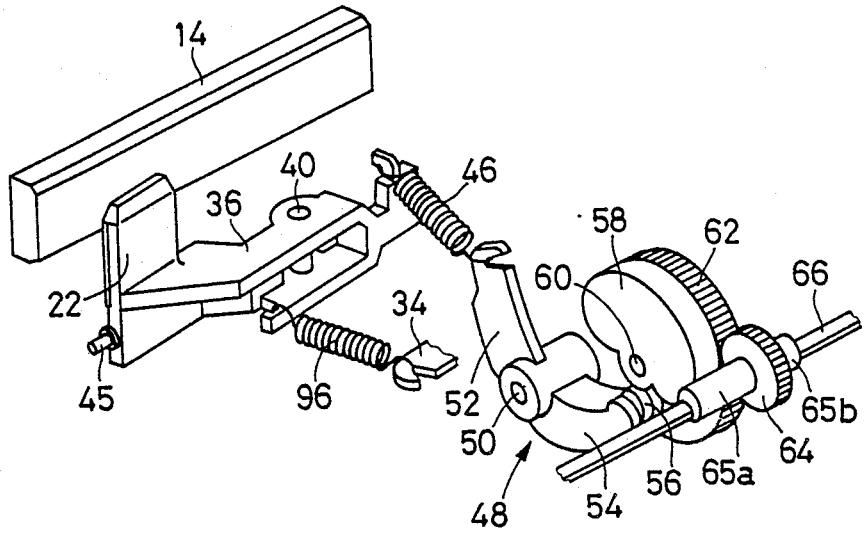
FIG. 3 is a perspective view of an actuator unit build in the mechanism of FIG. 2, while a thermal print head is placed in its release position.

As shown in FIG. 3, the cam lever 48 has a pair of integrally formed arms 52, 54 which extend from the shaft 50, away from each other. The head-presser spring 46 is a tensile coil spring whose turns are normally held in contact with each other. In other words, the head-presser coil spring 46 is given a predetermined tensile pre-load, and will not be elastically deformed or elongated until a load exceeding the tensile pre-load is applied to the spring 46. This coil spring 46 connects the rear end of the print-head support lever 36 and the free end of the arm 52 of the cam lever 48. The other arm 54 of the cam lever 48 has a roller 56 rotatably supported thereon, and is adapted to engage a head-presser cam or first cam 58 through the roller 56.

In the present embodiment, the head-presser cam 58 consists of a peripheral cam which is considered as a first rotatable member which is rotated about an axis (cam shaft) 60. On the other hand, the cam lever 48 which follows the head-presser peripheral cam 58 is consdered as a first displaceable member which is displaced as the head-presser cam 58 is rotated. The cam lever 48 and the head-presser cam 58 constitute a first converting mechanism wherein a rotating movement of the cam 58 is converted into a pivotal displacement of the cam lever 48.

The cam shaft 60 which supports the head-presser cam 58 extends parallel to the shaft 50 for the cam lever 48, and is rotatably supported by the unit frame 34. To the cam 58, there is fixed a driven gear 62 in a concentric relation. The driven gear 62 engages a drive gear 64 on a drive rod 66. This rod 66 is formed from a round bar, by cutting the bar so as to form parallel flats, so that the obtained drive rod 66 engages the drive gear 64 slidably in its longitudinal direction, but is not rotatable relative to the gear 64. As indicated in FIGS. 2 and 3, the drive gear 64 is prevented from being moved relative to the unit frame 34, by two spacer sleeves 65*a*, 65*b* and a pair of vertical walls 34*a*, 34*b* of the unit frame 34. The drive gear 64 slides on the drive rod 66 while the carriage 10 is moved.

The drive rod 66 which engages the drive gear 64 in the manner as described above extends parallel to the platen 14, through round holes 68, 70 formed in opposite side walls 10*a*, 10*b* of the carriage 10, and through holes 72, 72 formed in the vertical walls 34*a*, 34*b* of the unit frame 34, as shown in FIG. 2. The drive rod 66 is rotatably supported by the printer frame 16, and is coupled at its one end to a drive motor 74 via a pair of gears 75*a*, 75*b*, as shown in FIG. 1. In this arrangement, a rotating movement of the drive rod 66 caused by the motor 74 is imparted to the head-presser cam 58 through the drive gear 64 and the driven gear 62.

Figure 5:
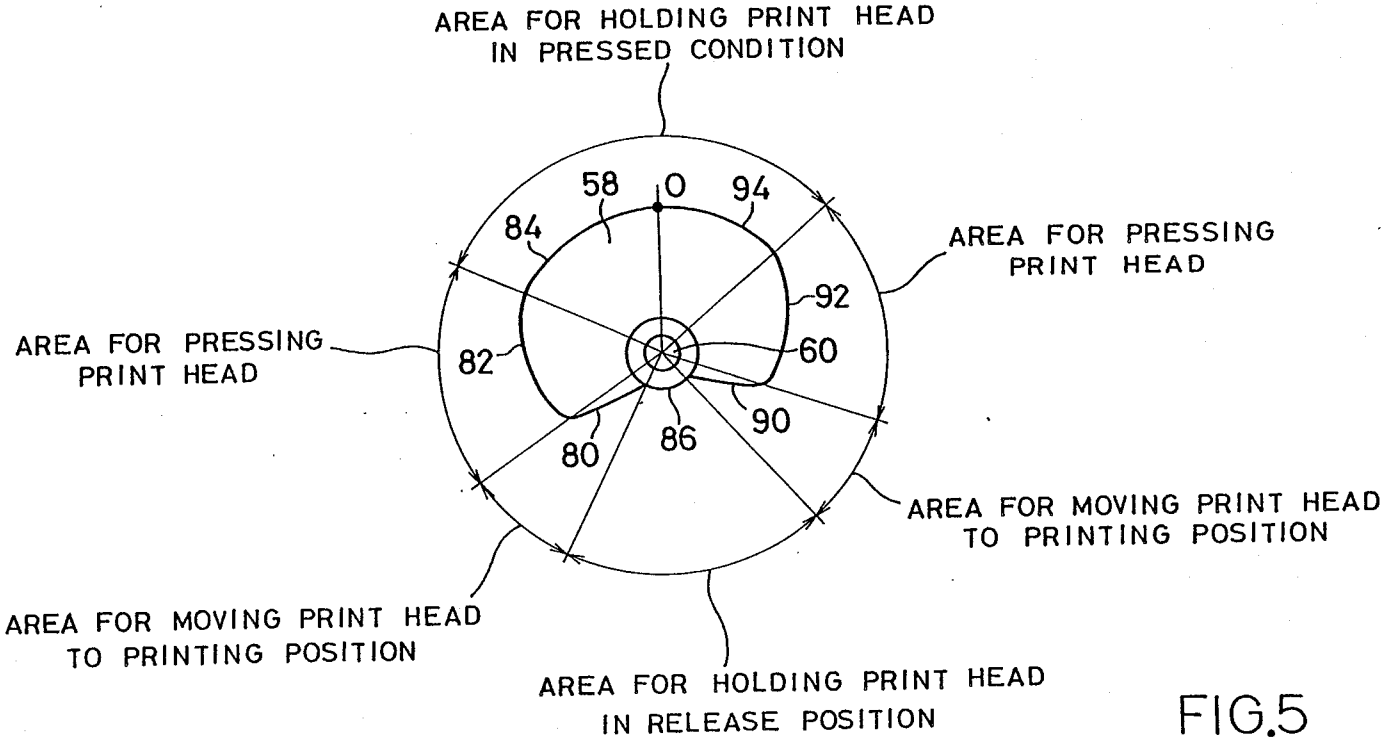
FIG. 5 is a plan view showing a profile of a head-presser cam of the actuator unit of FIG. 2.

The profile of the head-presser cam 58 is shown in FIG. 5. A cam surface on the left half of the cam 58 as seen in FIG. 5 includes a first area 80, a second area 82 and a fourth area 84, which are formed such that the fourth area 84 terminates in the second area 82, which in turn terminates in the first area 80, which in turn terminates in a third area 86. The third area 86 consists of a basic cylindrical surface which defines a base circle of the cam. Similarly, a cam surface on the right half of the cam 58 includes a first area 90, a second area 92 and a fourth area 94 which terminates in the fourth area 84 on the left half. The first area 90 terminates in the end of the third area 86 remote from the first area 80 on the left half. Thus, the cam surface on the left half of the cam 58 and the cam surface on the right half are formed symmetrical with each other with respect to a straight line which passes the center of the shaft 60 and the connecting point (indicated at 0) between the fourth areas 84, 94.

The first area 80 which extends from the base circle (86) has a considerably greater gradient than the second area 82. Namely, the first area 80 gives the cam lever 48 a greater amount of pivotal displacement per unit angle of rotation of the head-presser cam 58, than the second area 82. The second area 82 consists of a smooth curve formed such that the radial distance from the center of the cam shaft 60 is gradually increased as the cam 58 is rotated. For instance, the gradients of the first and second areas 80, 82 are determined so that an amount of lift of the roller 56 of the cam lever 48 which is provided by the second area 82 is about ½ to ⅓ of that provided by the first area 80. The fourth area 84 is defined by an arc of a circle having its center on the center of the cam shaft 60, so that the cam lever 48 is not displaced while the roller 56 follows the fourth area 84.

The first area 80 of the cam surface of the cam 58 is used to produce a first movement of the cam lever 48 for moving the thermal print head 22 from its release position towards its printing position. The second area 82 is used to produce a second movement of the cam lever 48 for pressing the print head 22 against the paper 20 and the ink ribbon 26. The third area 86 is provided to stably hold the print head 22 in its release position, and the fourth area 84 is provided to stably hold the print head 22 in pressed contact with the paper sheet 20.

The configurations and functions of the first, second and fourth areas 90, 92, 94 on the right half of the cam 58 are identical with those of the corresponding areas 80, 82, 84. The symmetric relation of the cam surfaces on the left and right halves of the cam 58 permits the cam lever 48 to be displaced in the same manner irrespective of whether the cam 58 is rotated in the clockwise direction or counterclockwise direction.

As shown in FIG. 3, the print-head support lever 36 is also connected to the unit frame 34 by a head-release coil spring 96 which is given a predetermined tensile pre-load. The coil spring 96 biases the support lever 36 so as to rotate the lever 36 in a direction opposite to the direction in which the lever 36 is pivoted by means of the head-presser spring 46 when the head-presser cam 58 is operated. Thus, the thermal print head 22 is normally held in its release position in which the head 22 is spaced away from the paper sheet 20. The biasing force of the head-release spring 96 when it is elongated to the maximum extent corresponding to the printing position of the print head 22 is determined to be smaller than the predetermined tensile pre-load of the head-presser spring 46. Accordingly, the head-presser support lever 36 can be pivoted against the biasing force of the head-release spring 96, to bring the print head 22 to its printing position, without the head-presser spring 46 being elastically deformed or elongated. In this pivotal movement of the support lever 36, the head-presser spring 46 is considered as if it were a rigid connecting link.

Referring back to FIG. 2, the previously indicated ribbon-presser member 98 is provided in the form of a blade at the end of the ribbon-presser support lever 38. This ribbon-presser blade 98 is moved to press the ink ribbon 26 against the sheet 20 when printed characters on the sheet 20 are erased. The blade 98 is positioned a suitable distance away from the print head 22 in a direction parallel to the platen 14, i.e., along the line of printing by the print head. With a pivotal movement of the support lever 38, the ribbon-presser blade 98 can be moved between its operated position in which the blade 98 is in pressed contact with the sheet 20 via the ink ribbon 26, and a non-operated or retracted position in which the blade 98 is spaced away from the sheet 20. With the ink ribbon 26 pressed by the blade 98 as well as by the print head 22, the ink material once transferred to the sheet 20 can be removed by the ink ribbon 26, whereby erasing and correcting operations can be performed.

Described in greater detail, the inking material of the ink layer of the ink ribbon 26 used for the instant printer 2 has substantially no adhesive property at the room temperature, and becomes fused at a predetermined printing temperature. The composition of the inking material is selected so that the ink layer provides a suitable magnitude of adhesive force at an intermediate temperature between the room temperature and the printing temperature. When a printing operation is effected, only the thermal head 22 is pressed against the paper sheet 20 via the ink ribbon 26, and is moved along the platen 14 while the heat-generating elements 42 are selectively energized at appropriate printing positions to heat and fuse the corresponding portions of the ink layer. Since the ribbon-presser blade 98 is in the retracted or non-operated position, the used length of the ink ribbon 26 is immediately separated from the sheet 20 as the head 22 is moved, whereby the fused portions of the ink layer are transferred to the sheet 20. Thus, the printing operation is performed. When an erasing operation is performed, on the other hand, both the print head 22 and the ribbon-presser blade 98 are pressed against the sheet 20 via the ink ribbon 26, and the printed characters to be erased are overstruck by the print head 22 with the heat-generating elements 42 energized according to the same printing data used for printing the printed characters. Although the heated portions of the ink layer of the ribbon 26 remain in a fused state for a short time after the heating, the heated portions will cool to the above-indicated intermediate temperature by the time when the heated portions of the ink layer reach the ribbon-presser blade 98, that is, while the heated portions are held pressed against the sheet 20. Consequently, the inking material forming the printed characters on the sheet 20 can be transferred back to the ink ribbon 26, due to an adhesive force produced at the lowered intermediate temperature. In other words, the ribbon-presser blade 98 in the operated position functions to permit the ink ribbon 26 to be separated from the sheet 20 only after the adhesive force of the heated part of the ink layer increases to cause the previously applied inking material to be transferred back to the ink layer. Thus, the printed characters can be erased. In this respect, the distance between the thermal print head 22 and the ribbon-presser blade 98, the heating temperature of the heat-generating elements 42, and other conditions are suitably determined, depending upon the composition of the ink layer of the ribbon 26, feedrate of the print head 22, and other parameters.

Referring to FIG. 10, the ribbon-presser blade 98 has a slightly curved surface **98*a* on the side nearer to the print head 22. The curved surface 98*a* progressively approaches the surface of the paper sheet 20 as it is curved toward its tip contacting the sheet 20. Further, the blade 98 has a surface 98*b* on the side remote from the print head 22. This surface 98*b* is substantially perpendicular to the surface of the sheet 20. The slightly curved surface 98*a* primarily serves to guide the ink ribbon 26 so as to hold the ribbon 26 in pressed contact with the sheet 20, while the perpendicular surface 98*b* primarily serves to assure a sufficient angle of bend for separating the ink ribbon 26 from the surface of the sheet 20**, so as to completely remove the previously applied material.

The ribbon-presser support lever 38 is operated by a converting mechanism identical with that used for the print-head support lever 36. This support lever 38 is also driven by the drive motor 74, and is connected to a second cam lever 102 (as a second displaceable member) via a ribbon-presser spring 100, as shown in FIG. 2. The ribbon-presser spring 100 is also a tension coil spring which is given a predetermined tensile pre-load. A ribbon-presser release spring 104 having a smaller biasing force than the ribbon-presser spring 100 is provided to connect the support lever 38 and the unit frame 34, so that the ribbon-presser blade 98 at the end of the support lever 38 is normally held in its non-operated position. The shaft 50 used for the first cam lever 48 is also used to rotatably support the second cam lever 102, such that the first and second cam levers 48, 102 are rotatable independently of each other. The second cam lever 102 has a roller 106 which is adapted to engage a ribbon-presser cam 108 (second rotatable member).

Figure 6:
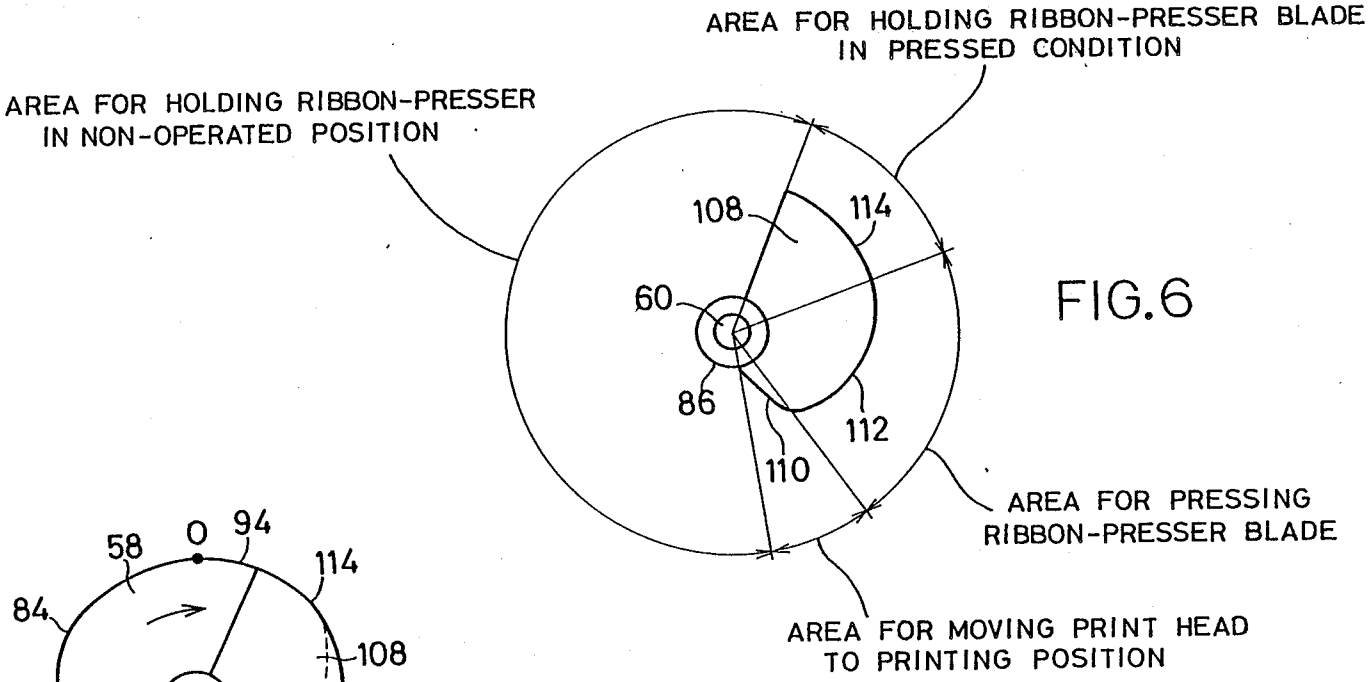
FIG. 6 is a plan view showing a profile of a ribbon-presser cam of the actuator unit of FIG. 2.

As shown in FIG. 6, the ribbon-presser cam 108 has a cam surface which includes a first area 110, a second area 112, a third area 86 and a fourth area 114, which are similar in function to the corresponding areas 80 (90), 82 (92), 86 and 84 (94) of the head-presser cam 58. The third area 86 defines an arc of a base circle of the cam 108 for holding the ribbon-presser blade 98 in its non-operated position, and the first area 110 extends from one end of the arc of the third area 86, so as to provide a comparatively large gradient so that the ribbon-presser blade 98 is rapidly moved from the non-operated position to the operated position. The second area 112 which extends from the first area 110 has a gradient smaller than that of the first area 110, so that the ribbon-presser blade 98 in the operated position is pressed against the ink ribbon 26 at a comparatively low rate. The fourth area 114 defines an arc of a circle whose center is located at the center of the cam shaft 60, so that the ribbon-presser blade 98 is held in the pressed contact with the ink ribbon 26 and the paper sheet 20.

Figure 7:
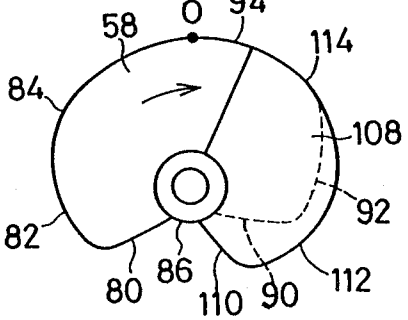
FIG. 7 is a plan view showing the profiles of the head-presser and ribbon-presser cams while these cams are held in a predetermined angular relation with each other.

As indicated above, the ribbon-presser cam 108 is fixedly supported on the cam shaft 60 which also support the head-presser cam 58. These two cams 58, 108 are positioned in coaxial or concentric relation with each other, such that the areas 110, 112, 114 of the cam 108 are offset from the corresponding areas 90, 92, 94 of the cam 58 from each other in a rotating direction of the cams 58, 108. Described more specifically by reference to FIG. 7, the angular phases of the head-presser cam 58 and the ribbon-presser cam 108 are offset from each other by a suitable angle, for example, about 30 degrees, such that the profile of the first and second areas 110, 112 of the cam surface of the ribbon-presser cam 108 is not aligned with the profile of the corresponding cam surface areas 90, 92. The two cams 58, 108 are secured to the cam shaft 60 for synchronous rotating movements while maintaining the angular relationships indicated above. In the present specific embodiment, the angular or circumferential offset of the cams 58, 108 is determined so that the cam surface area 110 of the ribbon-presser cam 108 leads the corresponding cam surface area 90 of the head-presser cam 58, when the cams 58, 108 are rotated in the clockwise direction as seen in FIG. 7. Upon synchronous rotations of the cams 58, 108 in the clockwise direction, therefore, the ribbon-presser blade 98 initiates its movement from its non-operated position to its operated position to press the ink ribbon 26 against the paper sheet 20, before the print head 22 initiates its movement from its release position to its printing position to press the paper sheet 20 against the platen 14. In other words, the print head comes into contact with the sheet 20 via the ribbon 26, after the ribbon-presser blade 98 has contacted the ink ribbon 26. This sequence of movements of the print head 22 and the blade 98 is desirable for the following reason. That is, if the ink ribbon 26 is first pressed against the sheet 20 by the print head 22, the already used re-wound portion of the ribbon 26 tends to be pulled back from a take-up spool 148 (which will be described referring to FIG. 9) when the ink ribbon 26 is subsequently pressed by the ribbon-presser blade 98. However, this tendency will not arise when the ribbon 22 is first pressed by the blade 98.

Figure 8:
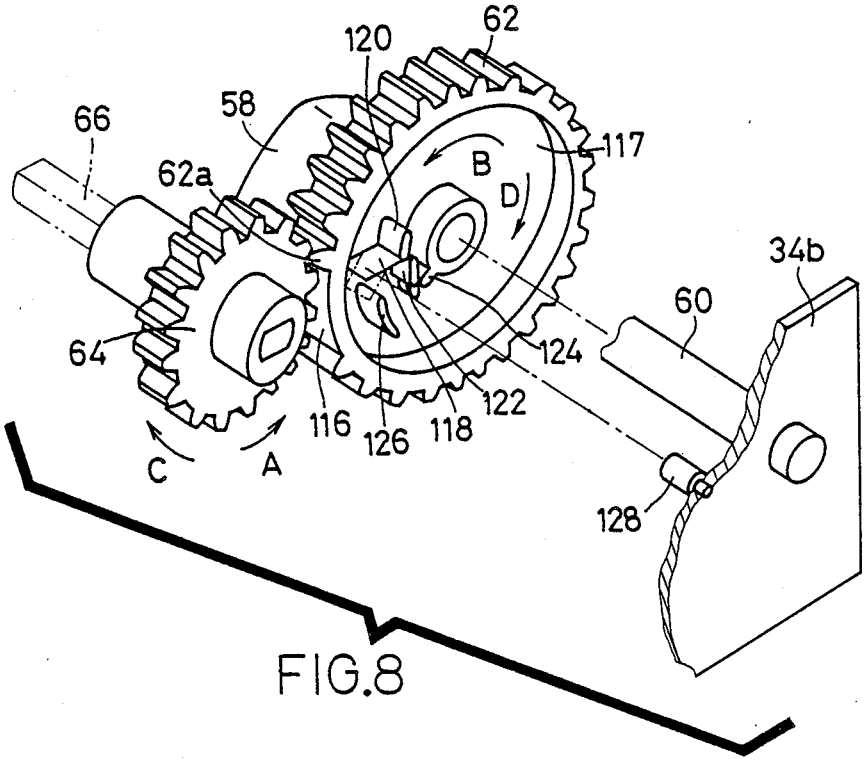
FIG. 8 is a perspective view of a reference-position detecting device for detecting refererence points of the head-presser and ribbon-presser cams.

Referring to FIG. 8, there will be described a reference-position detecting device for detecting a reference point (zero point) of the cams 58, 108, which point is indicated at 0 in FIGS. 5 and 7. The detecting device includes the driven and drive gears 62, 64 which have been described above.

The driven gear 62 has a non-toothed circumferential portion 116 in which no teeth are formed. The circumferential length of this non-toothed portion 116 corresponds to five or six teeth, for example. The non-toothed portion 116 is formed such that one of its circumferential ends is aligned with the reference point 0 which is a connecting point between the two fourth areas 84, 94 of the cam surfaces on the left and right halves of the head-presser cam 58, as indicated in FIG. 5. Namely, the angular position of the non-toothed portion 116 relative to the cams 58, 108 is determined so that a special tooth **62*a* adjacent to the above-indicated end of the non-toothed portion 116 engages the drive gear 64 when the roller 56 (FIG. 3) of the cam lever 48 is located at the reference point 0 of the head-presser cam 58**.

The driven gear 62 has an annular recess 117 in one of opposite faces which faces the vertical wall **34*b* of the unit frame 34. Within this annular recess 117, there is fixed a plate spring 118 which is positioned so as to serve its biasing function just before the drive gear 62 comes into engagement with the special tooth 62*a* of the driven gear 62. The plate spring 118 cooperates with a stop pin 128 (which will be described) to bias the driven gear 62 in order to maintain the engagement of the special tooth 62*a* with the drive gear 64. The driven gear 62 has three retainer portions 120, 122, 124 which extend from the bottom of the annular recess 117. The retainer portions 120, 122, 124 retain an L-shaped end of the plate spring 118 such that the spring 118 extends in the radial direction of the gear 62, in a cantilever fashion. Adjacent to the free end of the plate spring 118, there is disposed a lug 126 fixed to the bottom of the recess 117. This lug 126 prevents the plate spring 118** from being elastically deformed beyond its limit.

The above-indicated stop pin 128 is fixed on the vertical wall **34*b* of the unit frame 34. This stop pin 128 extends into the annular recess 117 and is positioned for abutting engagement with the plate spring 118 when the drive gear 64 engages the special tooth 62*a* of the driven gear 62 which is provided adjacent to the end of the non-toothed portion 116. Since the operation to establish the reference point of the cams 58, 108 takes place by rotating the drive and driven gears 62, 64 in directions A and D (FIG. 8), respectively, the stop pin 128 abuts on one of opposite surfaces of the plate spring 118 which is remote from the lug 126. As a result, the plate spring 118 is elastically deformed toward the lug 126, as indicated in broken line in FIG. 8**.

When the thermal printer 2 is initialized to start a printing operation, the drive motor 74 is operated to rotate the drive gear 64 in the direction A, whereby the driven gear 62 is rotated in the direction D. During the rotation of the driven gear 62, the plate spring 118 comes into abutment on the stop pin 128 just before the special tooth **62*a* engages the drive gear 64. Consequently, the plate spring 118 elastically yields, and the special tooth 62*a* engages the corresponding tooth of the drive gear 64. In the presence of the non-toothed portion 116 adjacent to the special tooth 62*a*, and the elastic yielding of the plate spring 118, the driven gear 62 can be held in an angular position substantially determined by the stop pin 128. The drive motor 74 is operated by an angle sufficient to bring the drive gear 64 into engagement with the special tooth 62*a*, irrespective of the angular phase of the driven gear 62 at the time the motor 74 is started. Namely, the motor 74 is turned off only after the drive gear 64 has engaged the special tooth 62*a*. When the motor 74 is turned off, the elastically deformed plate spring 118 biases the driven gear 62 in a direction B (FIG. 8), so as to maintain the special tooth 62*a* in engagement with the drive gear 64. In this manner, the reference point or reference angular position of the head-presser and ribbon-presser cams 58, 108 is established. In this reference angular position, the roller 56 of the cam lever 48 (FIG. 3) is located at the reference point 0 of the head-presser cam 58, at which the print head 22 is held in pressed contact with the paper sheet 20**.

Subsequently, the drive motor 74 is operated to rotate the drive gear 64 in a direction C as indicated in FIG. 8. Since the drive gear 64 is held in engagement with the special tooth **62*a* of the driven gear 62 by the biasing force of the plate spring 118, the drive and driven gears 64, 62 rotate in meshing engagement with each other. Thus, the plate spring 118 prevents an otherwise possible interference or collision of the special tooth 62*a* with the teeth of the drive gear 64 at the time the rotation of the drive gear 64 in the direction C is started. The drive motor 74 is turned off when the drive gear 64 has been rotated about 180 degrees. In this condition, the rollers 56, 106 of the first and second cam levers 48, 102 are held at the intermediate position on the third areas 86 of the cams 58, 108, respectively, whereby the print head 22 and the ribbon-presser blade 98** are held in the release and non-operated positions, respectively.

It follows from the foregoing description that the actuator unit 30 includes: the first converting mechanism for converting a rotating movement of the head-presser cam 58 (first rotatable member) into a pivotal movement of the first cam lever 48 (first displaceable member) for moving the thermal print head 22 between its release and printing positions; a second converting mechanism for converting a rotating movement of the ribbon-presser cam 108 (second rotatable member) into a pivotal displacement of the second cam lever 102 (second displaceable member) for moving the ribbon-presser blade 98 between its non-operated and operated positions, and the reference-position detecting device for detecting the reference point 0 of the cams 58, 108. These mechanisms and device are assembled as a sub-assembly on the unit frame 34 as indicated in FIG. 2. This sub-assembly is mounted on the carriage 10, with the unit frame 34 secured to the bottom of the carriage 10 by screws 130, 132. More specifically, the carriage 10 has a bottom surface 134 on which the actuator unit 30 rests, and several positioning surfaces 136, 138, etc. for accurately positioning the unit frame 34 in place. The drive rod 66 is inserted through the drive gear 64, extending through the round holes 68, 70, for coupling the drive gear 64 to the drive motor 74.

A guide plate 140 having a guide slot 141 is secured to the side wall **10*b* with screws 142, 144. The guide slot 141 is formed so as to be engageable with the guide pin 45 at the end of the print-head support lever 36 when the print head 22 has been moved to a position near the paper sheet 20 as a result of a pivotal motion of the support lever 36. Accordingly, the guide pin 45 and the guide slot 141 cooperate to prevent a vertical movement of the free end of the support lever 36 during its pivotal movements, thereby permitting the print head 22** to be positioned at a predetermined vertical position when placed in its printing position.

The carriage 10 may be formed from suitable metallic materials or integrally molded of a suitable resin material. In the latter case, the carriage 10 may have a complicated configuration. While the unit frame 34 may also be formed of a resin material, it is preferred to use a metallic material, since the unit frame 34 should have sufficient strength and rigidity for supporting the shafts 40, 50, etc. and for fixing thereto the release springs 96, 104. On the other hand, the head-presser spring 46 for moving the print head 22, and the ribbon-presser spring 100 for moving the ribbon-presser blade 98 are connected to the metallic unit frame 34. Accordingly, the comparatively large biasing forces of these springs will not be exerted on the structure of the carriage 10. For this reason, the carriage 10 may be molded of a resin material.

Figure 9:
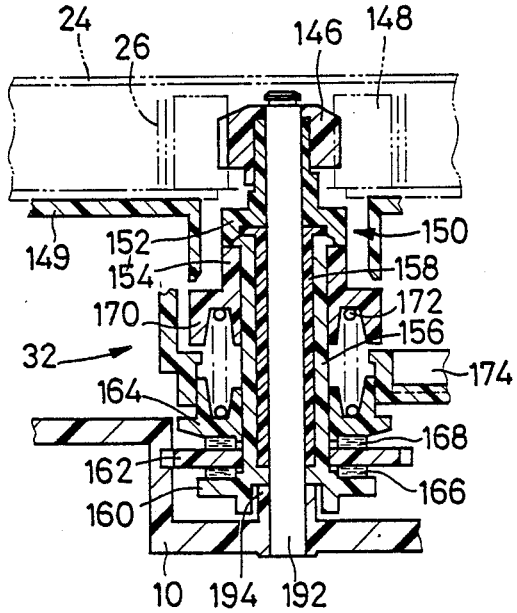
FIG. 9 is an elevational view in cross section of a ribbon take-up unit built in the mechanism of FIG. 2.

The ribbon take-up unit 32 will be described, referring to FIG. 9. This unit 32 includes a spool drive cam 146 which engages a take-up spool 148 which is disposed within the ribbon cassette 24 for re-winding the used length of the ribbon 26. Thus, the take-up spool 148 is rotated by the spool drive cam 146. Reference numeral 149 designates a covering member of the carriage 10. The spool drive cam 146 is fixed to a hollow cam shaft 150. This cam shaft 150 includes a first shaft member 152, a second shaft member 154 and a third shaft member 156, which are formed integrally in coaxial relation with each other. Within the hollow cam shaft 150, there is accommodated a bearing sleeve 158. The spool drive cam 146 is secured to the end portion of the first shaft member 152. The third shaft member 156 extends downwardly, and its lower end is formed with a radially outwardly extending flange 160. On the upper surface of this flange 160, there is bonded a felt 166.

A slip gear 162 engages the lower end of the third shaft member 156 of the hollow cam shaft 150. Above the slip gear 162, there is provided a felt receiver 164 which has a felt 168 bonded to its lower surface. The felt receiver 164 is fitted on the outer circumferential surface of the third shaft member 156, such that the receiver 164 is axially slidable relative to the third shaft member 156, and is rotatable with the same member 156. A suitably pre-loaded compression coil spring 172 is disposed between the felt receiver 164 and a spring receiver 170 formed on the second shaft member 154. This spring 172 biases the felt receiver 164 in the downward direction, for producing a predetermined friction force between the opposite surfaces of the slip gear 162 and the corresponding surfaces of the felts 166, 168. In this arrangement, a rotary motion of the rotating slip gear 162 can be transmitted to the cam shaft 150, as far as a torque necessary to rotate the cam shaft 150 is held below an upper limit. However, the rotating slip gear 162 will slip on the felts 166, 168 and fail to rotate the cam shaft 150 if the required torque to rotate the cam shaft 150 exceeds the upper limit, that is, if the cam shaft 150 is overloaded due to an excessive tension of the active portion of the ink ribbon 26 which is re-wound by the take-up spool 148.

A support arm 174 is fitted on the felt receiver 164 in coaxial relation with each other, such that the support arm 174 is rotatable relative to the felt receiver 164. This support arm 174 supports a first gear 176 and a second gear 178 integral with the first gear 176, as indicated in FIG. 2 such that these gears 176, 178 are rotatable about an axis parallel to the cam shaft 150. The first gear 176 engages the slip gear 162, while the second gear 178 engages a stationary rack 180 which is fixed on the printer frame 16. The rack 180 extends in the direction of movement of the carriage 10. The support arm 174 has an engaging portion 182 at its end, and the carriage 10 has another engaging portion 184, as shown in FIG. 2. A tension coil spring 186 is fixed at its opposite ends to the engaging portions 182, 184, in order to bias the support arm 174 for normally holding the second gear 178 in engagement with the rack 180. As the carriage 10 is moved relative to the rack 180, the second gear 178 engaging the rack 180, and the first gear 176 are rotated.

The support arm 174 is provided with an integrally formed cam portion 188 which extends toward the platen 14. The cam portion 188 has a cam surface 190 which is engageable with the thermal print head 22. Described more particularly, when the print head 22 is returned from the printing position to the release position, the print head 22 comes into contact with the cam surface 190, thereby pivoting the support arm 174 in the counterclockwise direction as seen in FIG. 2, against the biasing action of the coil spring 186. As a result, the second gear 178 is disengaged from the rack 180 while the first gear 176 remains engaged with the slip gear 162. Thus, the operative connection between the slip gear 162 and the rack 180 is interupted while the print head 22 is placed in its release position.

As described above, the ribbon take-up unit 32 includes the spool drive cam 146, hollow cam shaft 150, slip gear 164, felt receiver 176, felts 166, 168, first and second gears 176, 178, compression coil spring 172, support arm 174, and other various members. All of these members of the take-up unit 32 are assembled as a sub-assembly disposed about the axis of the hollow cam shaft 150.

The sub-assembly of the ribbon take-up unit 32 is mounted on a support shaft 192 fixed on the carriage 10. More specifically, the carriage 10 is formed with a boss 194 which fixedly receives the lower end of the support shaft 192. The take-up unit sub-assembly 32 is mounted such that the hollow cam shaft 150 is rotatably fitted on the support shaft 192. The unit 32 is held in position by a washer 196 and a retainer ring 198 which engages the upper end of the support shaft 192. Thus, the take-up unit 32 is mounted on the carriage 10, such that the second gear 178 is engageable with the stationary rack 180. To permit a movement of the second gear 178 upon a pivotal motion of the support arm 174, the bottom wall of the carriage 10 has an arcuate hole 199 through which the second gear 178 extends downwardly.

The operation of the thus constructed thermal printer 2 will be described.

Upon power application to the printer 2, an initializing routine is executed. This routine includes a step of establishing or detecting the reference point 0 (FIG. 7) of the head-presser and ribbon-presser cams 58, 108, by cooperative actions of the drive and driven gears 64, 62 and the stop pin 128 (FIG. 8). Then, the cams 58, 108 are rotated by a predetermined angle to bring the print head 22 and the ribbon-presser blade 98 to the release and non-operated positions, respectively.

When a printing start command is generated, the drive motor 74 is operated to rotate the cams 58, 108 in the counterclockwise (left) direction as seen in FIG. 7. That is, the cams 58, 108 are rotated in the counterclockwise direction in a normal printing operation, so that the cam 108 will not operate the ribbon-presser blade 98. The cam lever 48 (FIG. 3) is pivoted in the clockwise direction as the roller 56 follows the first area 80 of the cam surface on the left half of the head-presser cam 58. As a result, the pivotal movement of the cam lever 48 is imparted to the print-head support lever 36, through the head-presser spring 46. During this period of operation, the spring 46 maintains its original length and serves as if it were a rigid link member. In the meantime, the print-head support lever 36 is pivoted while elongating the head release spring 96. Consequently, the print head 22 is moved to the printing position adjacent to the platen 14. Since the first area 80 of the cam surface of the cam 58 has a comparatively large gradient, the print head 22 can be moved to the printing position at a comparatively high rate. Namely, a comparatively small angle of rotation of the cam 58 is required to bring the print head 22 to the printing position.

Figure 4:
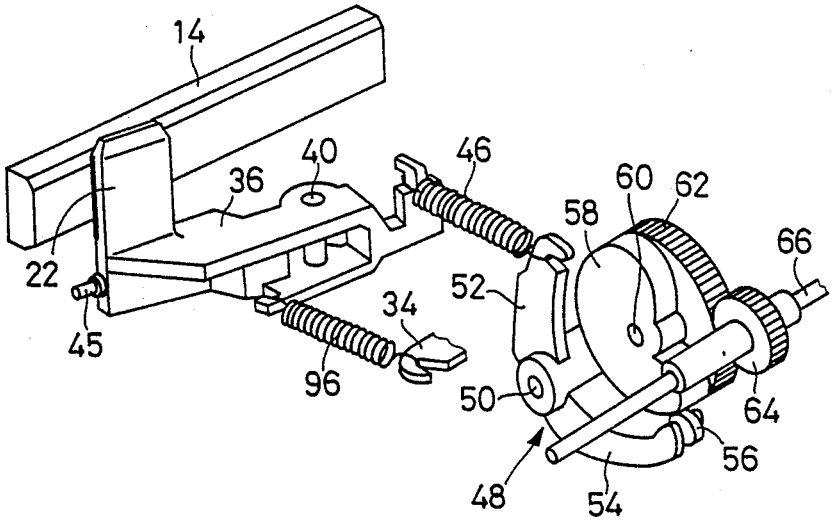
FIG. 4 is a perspective view of the actuator unit while the print head is placed in its printing position.

When the print head 22 has contacted the platen 14 via the ink ribbon 26 and the paper sheet 20 as indicated in FIG. 4, the print-head support lever 36 can no longer be moved. With a further rotation of the head-presser cam 58, the head-presser spring 46 is elastically deformed or elongated. The maximum operating length of the head-presser spring 46 is determined by the end of the second area 82, and determines the force by which the print head 22 is pressed against the platen 14. Since the second area 82 of the cam 58 has a gradient which is smaller than that of the first area 80, the pressing force exerted on the print head 22 is slowly increased, thereby avoiding a shock to the print head. After the leading end of the fourth area 84 of the cam 58 reaches the roller 56 on the cam lever 48, the head-presser spring 46 is no longer elongated. That is, the pressing force acting on the print head 22 is kept at a predetermined value, with the roller 56 held in contact with the fourth area 84 of the cam 58. In this condition, the carriage 10 is moved to effect a printing operation. The provision of the fourth area 84 eliminates an otherwise required high accuracy of control of the rotating angle of the cam 58 to establish the predetermined pressing force. Upon termination of printing along a line, the cams 58, 108 are rotated in the reverse direction to the original position, to allow the head-presser lever 36 to be pivoted back to the original position under the biasing action of the head release spring 96, whereby the print head 22 is returned from the printing position to the release position.

When an erasing operation is effected, the cams 58, 108 are rotated in the clockwise (right) direction as seen in FIG. 7. Initially, the roller 106 of the second cam lever 102 rolls on the first area 110 of the ribbon-presser cam 108, and the resulting pivotal movement of the cam lever 102 is imparted to the ribbon-presser support lever 38 via the ribbon-presser spring 100. Consequently, the ribbon-presser blade 98 is moved from the non-operated position to the operated position. After the movement of the blade 98 toward its operated position has been commenced, the roller 56 on the first cam lever 48 starts to roll on the first area 90 of the cam surface on the right half of the head-presser cam 58, whereby the movement of the print head 22 toward its printing position is also commenced. Because of this time lag, the ribbon-presser blade 98 starts to press the ink ribbon 26 and the sheet 20 against the platen 14, before the print head 22 reaches the printing position. In other words, the roller 106 starts to roll on the second area 112 of the ribbon-presser cam 108, and the ribbon-presser spring 100 starts its elastic deformation, before the print head 22 has reached the printing position. Described more precisely, the print head 22 comes into contact with the platen 14 via the ink ribbon 26 and the sheet 20, when the pressing force acting on the ribbon-presser blade 98 has been increased to the maximum level. Thereafter, the roller 56 rolls on the second area 92 and then on the fourth area 94, while the roller 106 rolls on the fourth area 114. Eventually, the sheet 20 and the ink ribbon 26 are pressed on the platen 14 by both the blade 98 and the print head 22, as illustrated in FIG. 10. In this condition, an erasing operation is performed.

The ink ribbon 26 is re-wound by the ribbon take-up unit 32 shown in FIG. 2 in both printing and erasing operations, while the carriage 10 is moved with the second gear 178 held in engagement with the stationary rack 180. As is apparent from FIG. 10, the ribbon cassette 24 has a stationary ribbon guide 200, and a plate spring 204 which has a felt member 202 at its free end, so that the ink ribbon 26 is passed through a nip between the guide 200 and the felt member 202, under the biasing force of the plate spring 204. In the presence of a friction force acting on the ink ribbon 26 at the guide 200, the ribbon 26 is supplied from a supply spool 205 toward the print head 22, by only the length which is re-wound by the take-up spool 148. Reference numeral 206 designates a plate spring (back-tensioning spring) for maintaining a proper tension of the ribbon 26, between the supply spool 205 and the print head 22. The spring 206 has a felt member 208 at its free end, which acts to bias the ribbon 26 in the reverse direction toward the supply spool 205. The used length of the ribbon 26 is re-wound on the take-up spool 148, such that a proper tension of the ribbon 26 is maintained between the print head 22 (blade 98) and the take-up spool 148, due to a slipping action of the slip gear 162 relative to the cam shaft 150 via the felt members 166, 168, when the tension of the ribbon 26 exceeds beyond the limit.

In the embodiment which has been described, the head-presser cam 58 and the ribbon-presser cam 108 are offset from each other in the rotating direction. However, the offset arrangment of the cams 58, 108 is not essential to practice the principle of the present invention. That is, the cams 58 and 108 may be positioned relative to each other such that the first areas 90 and 110 are aligned with each other. While the cams 58, 108 are peripheral or plate cams, they may be replaced by other types of cams such as plane cams (circular disc cam, grooved cam, etc.), and solid cams (cylindrical cam, etc.).

Further, the converting mechanisms for moving the print head 22 and ribbon-presser blade 98 may be replaced by other converting mechanisms which do not use the cams 58, 108. For example, a converting mechanism for the print head 22 may use a rotatable member having an eccentric pin which serves as a displaceable member connected by a spring to the print-head support lever 36, such that a displacement of the eccentric pin per unit angle of rotation of the rotatable member for moving the print head 22 to the printing position is greater than that for pressing the print head 22 against the platen 14.

While the various coil springs are used in the mechanisms for moving the print head 22 and the ribbon-presser member 98, these coil springs may be replaced by other types of biasing means such as plate springs and wire springs, and rubber or other elastic members. Further, the sub-assembly construction of the actuator unit 30 and ribbon take-up unit 32 is not essential.

Further, the principle of the present invention is applicable to a thermal printer which is not equipped with the ribbon-presser blade 98 and the ribbon-presser support lever 38, or a thermal printer which employs a thermal ink ribbon which includes an electrically resistive layer in addition to an ink layer. In the former case, the erasing operation discussed above cannot be performed. In the latter case, the print head has a plurality of recording electrodes which apply an electric current to selected local portions of the electrically resistive layer, to cause the local portions to generate heat and thereby fuse the corresponding portions of the ink layer. Moreover, the invention may be embodied as a printing apparatus which uses a heat-sensitive recording medium.

While the thermal printer 2 described above uses the reference-position detecting device shown in FIG. 8, it is possible to use modified forms of the detecting device, as illustrated in FIGS. 11–12, FIG. 13 and FIG. 14. These modified reference-position detecting devices will be described in greater detail. The same reference numerals as used in FIG. 8 will be used in FIGS. 11–14, to identify the corresponding components, and no redundant description of these components will be provided, in the interest of brevity and simplification.

Figure 11:
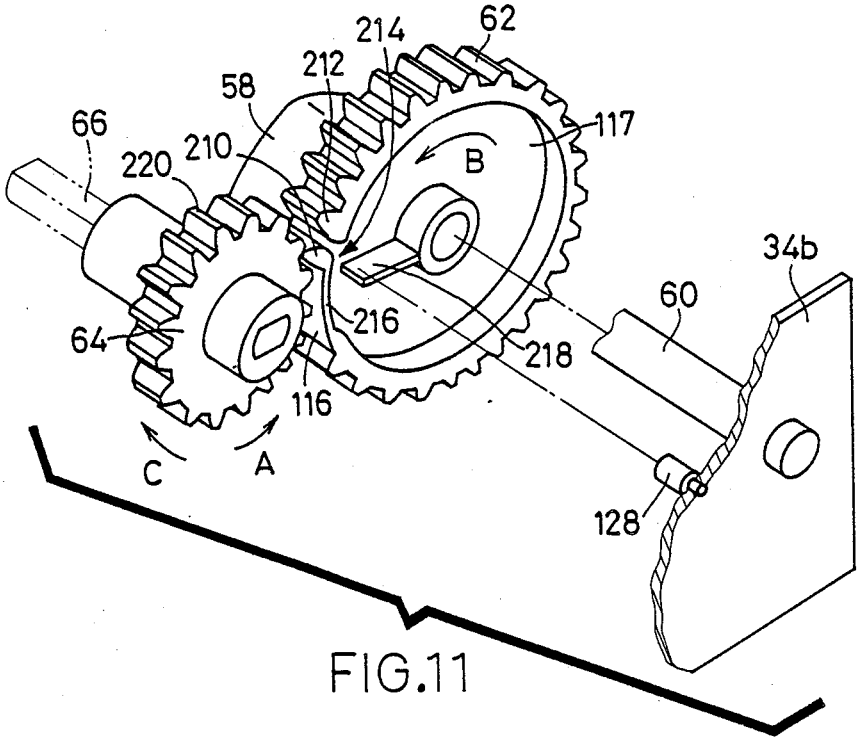
FIG. 11 is a perspective view corresponding to that of FIG. 8, showing a modified form of the reference-position detecting device used in another embodiment of the invention.
Figure 12:
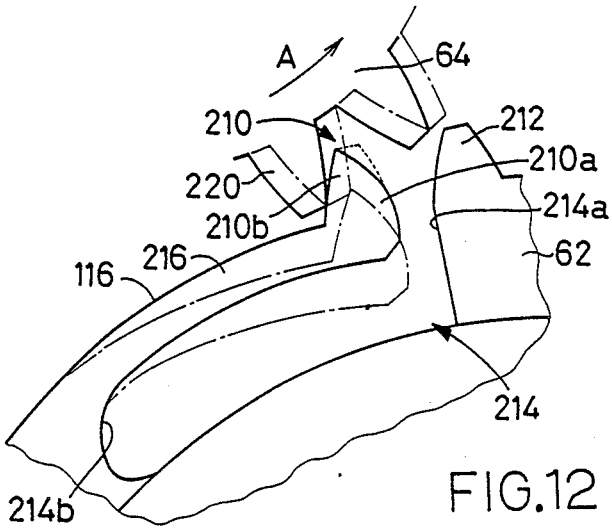
FIG. 12 is a fragmentary enlarged view of a part of the detecting device of FIG. 8.

In the first modified reference-position detecting device shown in FIGS. 11 and 12, the driven gear 62 has a special tooth 210 formed at one end of the non-toothed circumferential portion 116. As shown in FIG. 12, the driven gear 62 has a cutout 214 which consists of a radial cut **214*a* and an elongate arcuate recess 214*b*. The cut 214*a* is formed through a bottom land of the gear 62 between the special tooth 210, and a tooth 212 next to the special tooth 210. The recess 214*b* extends from the cut 214*a* in the circumferential direction of the gear 62. That is, the recess 214*b* is formed in the inner surface of the non-toothed portion 116 defining the annular recess 117, so as to reduce the thickness of the non-toothed portion 116. As a result, the non-toothed portion 116 serves as an arcuate spring portion 216 which is integral with the body of the gear 62. In other words, the arcuate spring portion 216 has the special tooth 210 integrally formed at its free end. Accordingly, the special tooth 210 may be moved substantially in the radial direction of the driven gear 62, due to elasticity of the arcuate spring portion 216. Thus, the spring portion 216 serves as means for elastically supporting the special tooth 210 on the driven gear 62**.

While the special tooth 210 may have the same configuration as the other teeth (212) of the driven gear 62, the tooth 210 provided in this embodiment is formed such that its surface **210*a* on the side remote from the non-toothed portion 116 has a greater curvature than the corresponding surface of the other teeth (212), and such that the upper half of the special tooth 210 has a relatively pointed tip, as shown in FIG. 12**. The above-indicated surface serves as a relief surface.

In the present embodiment, the gear 62 is formed with an abutting member 218 integrally fixed on the bottom surface of the annular recess 117, so as to extend in the radial direction. This abutting member 218 cooperates with the stop pin 128 to serve as means for holding the driven gear 62 at the predetermined reference angular position or reference point. The abutting member 218 is substantially aligned with the special tooth 212, like the plate spring 118 of FIG. 8 which is substantially aligned with the special tooth **62*a***.

In operation, the abutting member 218 comes into abutment on the stop pin 128 while the driven gear 62 is rotated by the drive gear 64 in the clockwise direction as seen in FIG. 11. When the driven gear 62 is stopped at the reference angular position by the stop pin 128, the drive gear 64 engages the special tooth 210 of the driven gear 62 as indicated in FIG. 11. In other words, the special tooth 210 engages the drive gear 64 when the driven gear 62 is stopped by the abutting engagement of the abutting member 218 with the stop pin 128, and the stop pin 128 determines the predetermined reference angular position of the driven gear 64, i.e., the head-presser cam 58 and the ribbon-presser cam 108 (not shown in FIG. 11).

Described more specifically, the drive motor 74 (FIG. 1) is operated to rotate the drive gear 64 in the direction A as indicated in FIG. 11. The drive motor 74 may be a stepper motor or a DC servo motor which is capable of being stopped at a desired angular position, once it is initialized to its reference position upon power application. During the rotating motions of the gears 62, 64, the non-toothed portion 116 of the driven gear 62 comes to a meshing point with the drive gear 64, and then the special tooth 210 comes into engagement with the drive gear 64 and at the same time the abutting member 218 comes into abutting contact with the stop pin 128, whereby the driven gear 62 is stopped at the predetermined reference angular position.

Usually, the drive motor 74 is not turned off when or just after the reference angular position is reached, for the reason explained in connection with the detecting device of FIG. 8. That is, the drive gear 64 usually continues to rotate in the direction A, with its teeth 220 successively engaging a surface **210*b* of the special tooth 210 on the side of the non-toothed portion 116 of the driven gear 62. At this time, each tooth 220 of the drive gear 64 serves as a cam member while the special tooth 210 serves as a cam follower movably supported at the free end of the arcuate spring portion 216. Described in detail referring to FIG. 12, the arcuate spring portion 216 elastically yields to permit the special tooth 210 to be moved toward the center of the gear 62 as the tooth 220 is moved in the circumferential direction of the drive gear 64, in sliding contact with the surface 210*b* of the special tooth 210. When the tooth 220 has cleared the surface 210*b*, the special tooth 210 is permitted to be moved in the radially outward direction under the biasing action of the arcuate spring portion 216, with the tooth 220 slidably contacting the smooth surface 210a. In this manner, the special tooth 210 of the stopped driven gear 62 is repeatedly moved in the radially inward and outward directions of the gear 62, while smoothly engaging the successive teeth 220 of the rotating drive gear 64, whereby the drive gear 64 continues to rotate without a considerable impact on the special tooth 210 of the driven gear 62** stopped at the reference angular position.

After the drive motor 74 is turned off after a predetermined angle of rotation, the special tooth 210 of the driven gear 62 is held in contact with the appropriate tooth 220 of the drive gear 64, under the biasing action of the arcuate spring portion 216. In this condition, the roller 56 of the first cam lever 48 (FIG. 3) is located at the reference point 0 at the connection of the two fourth areas 84, 94 of the head-presser cam 58, which is indicated in FIG. 5.

Subsequently, the drive motor 74 is operated to rotate the drive gear 64 in the direction C. Since the elastic force of the spring portion 216 of the driven gear 62 at rest biases the special tooth 210 against the teeth 220 of the drive gear 64, the drive gear 64 is biased in the direction C. Consequently, the driven and drive gear 62, 64 are held in meshing engagement without a backlash, and can be rotated at the same time as soon as the drive gear 64 starts to rotate upon activation of the drive motor 74. Further, the curved relief surface 210a and the pointed tip of the special tooth 210 prevent the tooth 210 from being moved in the radially outward direction toward the bottom land of the teeth 220, when the driven gear 62 is started to rotate in the direction B upon commencement of rotation of the drive gear 64 in the direction C.

Figure 13:
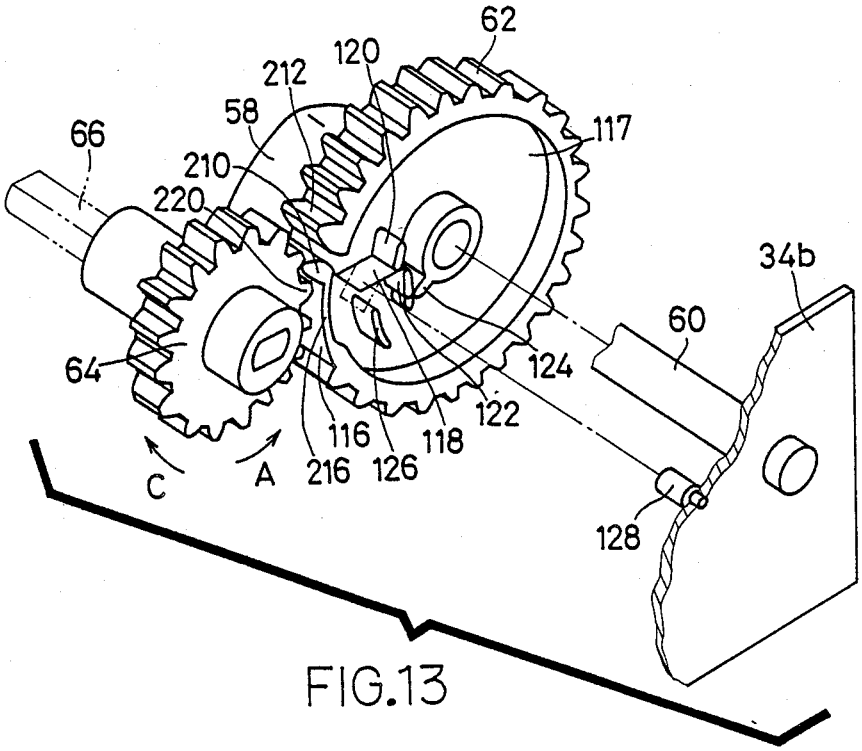
FIG. 13 is a view corresponding to that of FIG. 8, showing a further modified form of the detecting device.

Referring to FIG. 13, there is illustrated the second modification of the reference-position detecting device which is different from the device of FIGS. 11 and 12, in that the driven gear 62 has the plate spring 118 as used in the device of FIG. 8. In other words, the instant reference-position detecting device is different from the device of FIG. 8, in that the driven gear 62 has the arcuate spring portion 216 of FIGS. 11–12 which elastically supports the special tooth 210. In operation, the special tooth 210 is repeatedly moved in the radially inward and outward directions of the driven gear 62 during a rotating movement of the drive gear 64 after the driven gear 62 has been stopped at the reference angular position by the abutting engagement of the plate spring 118 with the stop pin 128. After the rotation of the drive gear 64 is stopped, the special tooth 210 is held biased against the teeth 220 of the drive gear 64 not only by the biasing force of the arcuate spring portion 216, but also by the biasing force of the plate spring 118 which acts on the gear 62 in the counterclockwise direction (in FIG. 13). Therefore, the gears 62, 64 are held at the reference angular position by a larger force of contact in the present embodiment, than in the embodiments of FIG. 8 and FIGS. 11–12. In the present embodiment, the tendency of the special tooth 210 moving in the radially outward direction upon rotation of the drive gear 64 in the direction C may be avoided, even if the special tooth 210 does not have the curved relief surface 210a (as shown in FIG. 12), that is, even if the special tooth 210 have the same configuration as the other teeth of the drive gear 62.

Figure 14:
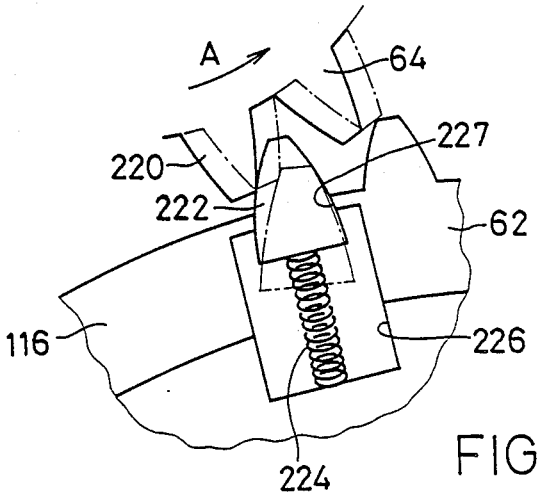
FIG. 14 is a fragmentary enlarged view of a still further modification of the detecting device.

The third modification of the reference-position detecting device is shown in FIG. 14, wherein the driven gear 62 is provided with a separately formed special tooth 222, which is elastically supported by a separate compression coil spring 224. More particularly, the non-toothed portion 116 of the driven gear 62 has a recess 226 formed in the direction of width of the teeth. The recess 226 is open to the outer surface of the non-toothed portion through an aperture 227. The special tooth 222 is supported such that its lower half is accommodated within the recess 224, while its upper half protrudes from the outer surface of the non-toothed portion 116 through the aperture 227. The special tooth 222 and the aperture 227 are so dimensioned that the special tooth 222 which is biased by the suitably preloaded compression coil spring 224 in the radially outward direction of the gear 62 is normally held in its outwardly advanced position by engagement of its intermediate portion with the terminal part of the non-toothed portion 116 which defines the aperture 227. In this arrangement, too, the special tooth 220 is repeatedly moved in the radially inward and outward directions of the stopped driven gear 62 at the reference angular position, when the drive gear 64 is rotated in the direction A after the driven gear 62 is stopped at the reference position by the stop pin 128. In the other aspects, the present detecting device is identical with the device of FIG. 13.

While the present invention has been described in its presently preferred embodiments with a certain degree of particularity, it is to be understood that the invention is not limited to the precise details of the illustrated embodiments, but may be embodied with various changes, modifications and improvements which may occur to those skilled in the art, without departing from the spirit and scope of the invention defined in the following claims.

What is claimed is:

1. A printing apparatus wherein a printing operation is effected by a print head which is movable relative to a recording medium while the print head and the medium are held in pressed contact with each other, said printing apparatus comprising:

a print-head support member for supporting said print head movably to a printing position in which the print head is in pressed contact with said medium, and to a release position in which the print head is spaced away from the medium;

drive means for moving said support member;

a converting mechanism including a rotatable member which is rotated by said drive means, and a displaceable member which is displaced as said rotatable member is rotated, whereby a rotating movement of said rotatable member is converted into a displacement of said displaceable member; and an elastic member connecting said support member and said displaceable member, to thereby move said print head from said release position to said printing position, and press said print head in said printing position against said medium with a predetermined force, said displacement of said displaceable member comprising a first movement for moving, via said elastic member, said print head from said release position to said printing position, and a second movement for enabling said elastic member to elastically deform and produce a biasing force for pressing said print head in said print position against said medium with said predetermined force, an amount of displacement of said displaceable member per unit angle of rotation of said rotatable member being greater in said first movement than in said second movement.

2. A printing apparatus according to claim 1, wherein said rotatable member comprises a cam having a cam surface, while said displaceable member comprises a cam follower which engages said cam surface, said elastic member being connected to said cam follower and said print-head support member, said cam surface including a first area for producing said first movement of said displaceable member, and a second area for producing said second movement of the displaceable member, said first area having a greater gradient than said second area.

3. A printing apparatus according to claim 1, further comprising biasing means for biasing said print-head support member toward said release position.

4. A printing apparatus according to claim 3, wherein said elastic member is given a pre-load greater than a biasing force of said biasing means, whereby said elastic member is prevented from initiating elastic deformation until said print head contacts said recording medium.

5. A printing apparatus according to claim 4, wherein said elastic member comprises a coil spring whose turns are held in circumferential contact with each other by a tensile pre-load greater than said biasing force of said biasing means.

6. A printing apparatus according to claim 1, further comprising:

an ink ribbon disposed so as to extend between said print head and said recording medium, and comprising an ink layer consisting of an inking material which is thermally fusible for adhesion to a surface of said medium;

a ribbon-presser member disposed away from said print head in a direction parallel to a line of printing by said print head, for pressing said ink ribbon against said recording medium;

a ribbon-presser support member for supporting said ribbon-presser member movably to an operated position in which the ribbon-presser member is in pressed contact with said medium via said ink ribbon, and to a non-operated position in which the ribbon-presser member is spaced away from the medium;

another converting mechanism including another rotatable member which is rotated by said drive means, and another displaceable member which is displaced as said another rotatable member is rotated, whereby a rotating movement of said another rotatable member is converted into a displacement of said another displaceable member;

another elastic member connecting said ribbon-presser support member and said another displaceable member, to thereby move said ribbon-presser member from said non-operated position to said operated position against said medium with a predetermined second force; and said displacement of said another displaceable member comprising of one movement for moving, via said another elastic member, said ribbon-presser member from said non-operated position to said operated position, and another movement for causing said another elastic member to elastically deform and produce a second biasing force for pressing said ribbon-presser member in said operated position against said medium with said predetermined second force, an amount of displacement of said another displaceable member per unit angle of rotation of said another rotatable member being greater in said one movement than in said another movement.

7. A printing apparatus according to claim 6, wherein said rotatable member comprises a first cam having a first cam surface, while said displaceable member comprises a first cam follower which engages said first cam surface, said elastic member being connected to said first cam follower and said print-head support member, said first cam surface including a pair of symmetrically disposed first areas each for producing said first movement of said displaceable member, and a pair of symmetrically disposed second areas each for producing said second movement of the displaceable member, said first area having a greater gradient than said second area, said first cam surface further including a third area for holding said print head in said release position during a corresponding movement of said first cam, said pair of second areas terminating in said pair of first areas, which in turn terminate in corresponding opposite ends of said third area, and wherein said another rotatable member comprises a second cam having a second cam surface, while said another displaceable member comprises a second cam follower which engages said second cam surface, said another elastic member being connected to said second cam follower and said ribbon-presser support member, said second cam surface including a first area for producing said one movement of said another displaceable member, and a second area for producing said another movement of said another displaceable member, said first area of said second cam surface having a greater gradient than said second area of said second cam surface, said second cam surface further including a third area for holding said ribbon-presser member in said non-operated position during a corresponding movement of said second cam, said second area of said second cam surface terminating in said first area of said second cam surface, which in turn terminates in said third area of said second cam surface.

8. A printing apparatus according to claim 6, wherein said print head, said print-head support member, said converting mechanism, said elastic member, said ribbon-presser member, said ribbon-presser support member, said another converting means and said another elastic member are mounted on a base as a sub-assembly, said printing apparatus further comprising a carriage movable along a line of printing by said print head, and means for mounting said base on said carriage and thereby incorporating said sub-assembly in said carriage.

9. A printing apparatus according to claim 6, wherein said drive means comprises an electrically operated motor for operating said rotatable member and said another rotatable member.

10. A printing apparatus according to claim 6, further comprising another biasing means for biasing said ribbon-presser support member toward said non-operated position.

11. A printing apparatus according to claim 1, further comprising a reference-position detecting device for detecting a reference point of said rotatable member, said drive means being operable to rotate said rotatable member selectively in opposite directions, within a predetermined angular range whose phase in determined by the detected reference point of said rotatable member.

12. A printing apparatus according to claim 11, wherein said reference-position detecting device comprises:

a drive gear driven by said drive means;

a driven gear engaging said drive gear and connected to said rotatable member, said driven gear including a non-toothed circumferential portion which has a special tooth at one of opposite circumferential ends thereof, said reference point of said rotatable member being established at a reference angular position of said driven gear in which said special tooth of said driven gear engages one of teeth of said drive gear;

means for holding said driven gear at said reference angular position; and means for elastically supporting said special tooth on said driven gear, and thereby allowing said special tooth to be retracted in a direction that permits said special tooth to be disengaged from the teeth of said drive gear while said driven gear is held in said reference angular position.

13. A printing apparatus according to claim 12, wherein said means for elastically supporting said special tooth comprises an elongate spring portion which has a fixed end connected to a body of said driven gear and which extends from said fixed end toward a free end thereof substantially in the circumferential direction of said driven gear, said special tooth being supported at said free end of said spring portion.

14. A printing apparatus according to claim 13, wherein said body of the driven gear has a cutout which includes a cut formed through a bottom land between said special tooth and a next tooth of said driven gear adjacent to said special tooth, said cutout further including a recess which extends from said cut, along said non-toothed circumferential portion, so as to define said elongate spring portion.

15. A printing apparatus wherein a printing operation is effected by a print head which is movable relative to a recording medium while the print head and the medium are held in pressed contact with each other, said printing apparatus comprising:

an ink ribbon disposed so as to extend between said print head and said recording medium, and comprising an ink layer including an inking material which is thermally fusible for adhesion to a surface of said medium;

a ribbon-presser member disposed away from said print head in a direction parallel to a line of printing by said print head, for pressing said ink ribbon against said recording medium;

a ribbon-presser support member for supporting said ribbon-presser member movably to an operated position in which the ribbon-presser member is in pressed contact with said medium via said ink ribbon, and to a non-operated position in which the ribbon-presser member is spaced away from the medium;

drive means for moving said support member;

a converting mechanism including a rotatable member which is rotated by said drive means, and a displaceable member which is displaced as said rotatable member is rotated, whereby a rotating movement of said rotatable member is converted into a displacement of said displaceable member; and an elastic member connecting said ribbon-presser support member and said displaceable member, to thereby move said ribbon-presser member from said non-operated position to said operated position, and press said ribbon-presser member in said operated position against said medium with a predetermined force, said displacement of said displaceable member comprising a first movement for moving, via said elastic member, said ribbon-presser member from said non-operated position to said operated position, and a second movement for causing said elastic member to elastically deform and produce a biasing force for pressing said ribbon-presser member in said operated position against said medium with said predetermined force, an amount of displacement of said displaceable member per unit angle of rotation of said rotatable member being greater in said first movement than in said second movement.

16. A printing apparatus according to claim 15, further comprising biasing means for biasing said ribbon-presser support member toward said non-operated position.

17. A printing apparatus including a print head mounted on a carriage for effecting a printing operation on a recording medium via an ink ribbon, comprising:

a first pivotable member supported on said carriage pivotally between a release position in which said print head is spaced away from said recording medium, and a printing position in which said print head is held in pressed contact with said medium via said ink ribbon;

a first elastic member;

a first cam follower connected to said first pivotable member through said first elastic member;

a first cam engaging said first cam follower, and having a first cam surface which includes a first area for a first movement of said first cam follower for moving said print head from said release position to said printing position, and a second area for a second movement of said first cam follower for pressing said print head in said printing position against said medium, said first area of said first cam surface having a greater gradient than said second area of said first cam surface, whereby an amount of displacement of said first cam follower per unit angle of rotation of said first cam is greater in said first movement thereof than in said second movement thereof;

a ribbon-presser member disposed away from said print head in a direction parallel to a line of printing by said print head, for pressing said ink ribbon against said medium;

a second pivotable member supported on said carriage pivotally between an operated position in which said ribbon-presser member is held in pressed contact with said medium via said ink ribbon, and a non-operated position in which said ribbon-presser member is spaced away from said medium;

a second elastic member;

a second cam follower connected to said second pivotable member through said second elastic member;

a second cam engaging said second cam follower, and having a second cam surface which includes a first area for a first movement of said second cam follower for moving said ribbon-presser member from said non-operated position to said operated position, and a second area for a second movement of said second cam follower for pressing said ribbon-presser member in said operated position against said medium, said first area of said second cam surface having a greater gradient than said second area of said second cam surface, whereby an amount of displacement of said second cam follower per unit angle of rotation of said second cam is greater in said first movement thereof than in said second movement thereof, said first and second cams being supported rotatably in synchronization with each other such that said first area of said first cam surface is offset from said first area of said second cam surface in a rotation direction of said first and second cams; and single drive means for rotating said first and second cams.

18. A printing apparatus according to claim 17, further comprising first biasing means for biasing said first pivotable member toward said release position, and second biasing means for biasing said second pivotable member toward said nonoperated position.

19. A printing apparatus according to claim 17, wherein said first areas of said first and second cam surfaces are offset from each other such that upon synchronous rotation of said first and second cams, said print head comes into contact with said medium via said ink ribbon after said ribbon-presser member presses said ink ribbon against said medium.

20. A printing apparatus according to claim 19, wherein said first cam surface of said first cam includes a pair of symmetrically disposed first areas each for producing said first movement of said first cam follower, and a pair of symmetrically disposed second areas each for producing said second movement of said first cam follower, said first areas having a greater gradient than said second areas, said first cam surface further including a third area for holding said print head in said release position during a corresponding rotation of said first cam, said pair of second areas terminating in said pair of first areas, which in turn terminate in corresponding opposite ends of said third area, and wherein said second cam surface of said second cam further includes a third area for holding said ribbon-presser member in said non-operated position during a corresponding rotation of said second cam, said second area of said second cam surface terminating in said first area of said second cam surface, which in turn terminates in said third area of said second cam surface, said first area of said second cam surface being offset from a corresponding one of said pair of first areas of said first cam surface in one of opposite rotation directions of said first and second cams, said first and second cams being rotated in said one rotation direction thereof when the printing apparatus effects an erasing operation, said first and second cams being rotated in the other rotation direction thereof when the printing apparatus effects a normal printing operation.

21. A printing apparatus according to claim 20, wherein said second area of said second cam surface is angularly aligned with a portion of said corresponding one of said pair of first areas of said first cam surface, and a portion of one of said pair of second areas of said first cam surface which terminates in said corresponding one of said pair of first areas of said first cam surface, in said one rotation direction, said third area of said second cam surface being angularly aligned with a portion of said third area of said first cam surface, the other first area of said first cam surface and the other second area of said first cam surface, in the other rotation direction.

22. A reference-position detecting device for detecting, as a reference point, a predetermined angular position of a driven gear by a drive gear, comprising:

a non-toothed circumferential portion formed integral with a body of said driven gear, and having a special tooth at one of opposite circumferential ends thereof, said predetermined angular position as said reference point being established when said special tooth of said driven gear engages the teeth of said drive gear;

means for holding said driven gear at said predetermined angular position, said non-toothed circumferential portion elastically supporting said special tooth, and thereby allowing said special tooth to be retracted radially inwardly of said driven gear without circumferential movement to thereby permit said special tooth to be disengaged from the teeth of said drive gear while said driven gear is held in said predetermined angular position, said body of said driven gear having a cutout which includes a cut formed through a bottom land between said special tooth and a next tooth of said driven gear adjacent to said special tooth, said cutout further including a recess which extends from said cut in the circumferential direction of said driven gear so as to define said non-toothed circumferential portion elastically supporting said special tooth.

* * * * *